US011160434B2

(12) United States Patent
Bhajak et al.

(10) Patent No.: US 11,160,434 B2
(45) Date of Patent: Nov. 2, 2021

(54) HEIGHT ADJUSTER MECHANISM FOR A DISHWASHER DISH RACK

(71) Applicant: WHIRLPOOL CORPORATION, Benton Harbor, MI (US)

(72) Inventors: Harshal J. Bhajak, Pune (IN); Joseph T. Ferencevich, Saint Joseph, MI (US); Gerald J. McNerney, Middleton, WI (US); Thomas M. O'Brien, Saint Joseph, MI (US); Mihir Ponkshe, Pune (IN); Amit K. Sharma, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 83 days.

(21) Appl. No.: 16/451,232

(22) Filed: Jun. 25, 2019

(65) Prior Publication Data

US 2019/0307312 A1 Oct. 10, 2019

Related U.S. Application Data

(60) Continuation of application No. 15/413,971, filed on Jan. 24, 2017, now Pat. No. 10,342,408, which is a division of application No. 14/574,439, filed on Dec. 18, 2014, now Pat. No. 9,596,975, which is a continuation-in-part of application No. 14/458,661, filed on Aug. 13, 2014, now Pat. No. 9,681,792, which is a division of application No. 13/110,048, filed on May 18, 2011, now Pat. No. 8,813,766.

(51) Int. Cl.
*A47L 15/50* (2006.01)
*A47L 15/42* (2006.01)

(52) U.S. Cl.
CPC ..... *A47L 15/504* (2013.01); *A47L 15/4246* (2013.01); *Y10T 29/49716* (2015.01)

(58) Field of Classification Search
CPC ..... A47L 15/504
See application file for complete search history.

(56) References Cited

U.S. PATENT DOCUMENTS

| | | | |
|---|---|---|---|
| 2,998,290 | A | 8/1961 | Sharpe |
| 3,472,573 | A | 10/1969 | Geiger |
| 3,560,069 | A | 2/1971 | Doepke |
| 3,734,589 | A | 5/1973 | Morgan |
| 3,761,153 | A | 9/1973 | Guth |
| 3,768,883 | A | 10/1973 | Kauffman |
| 3,809,450 | A | 5/1974 | Guth |
| 3,809,451 | A | 5/1974 | Pitstick |

(Continued)

FOREIGN PATENT DOCUMENTS

| | | |
|---|---|---|
| EP | 0788763 A2 | 8/1997 |
| GB | 1233388 | 5/1971 |

(Continued)

*Primary Examiner* — Spencer E. Bell
(74) *Attorney, Agent, or Firm* — Price Heneveld LLP

(57) ABSTRACT

A dish rack is supported for both selective movement into and out of a washing chamber of a dishwasher tub and vertically relative to the tub, with the vertical adjustment being made by manually grasping and shifting at least one frontal cross bar extending about a front wall of the dish rack to cause pivoting of first and second lever members extending along sides of the dish rack. The side lever members cooperate with latching mechanisms to lift and retain the dish rack in a select raised position.

16 Claims, 34 Drawing Sheets

(56) References Cited

U.S. PATENT DOCUMENTS

| | | | |
|---|---|---|---|
| 3,822,085 | A | 7/1974 | Clark |
| 3,892,453 | A | 7/1975 | Daily |
| 4,064,887 | A | 12/1977 | Geiger et al. |
| 4,097,099 | A | 6/1978 | Spiegel |
| 5,115,822 | A | 5/1992 | Nichols |
| 5,474,378 | A | 12/1995 | Smith et al. |
| 5,480,035 | A | 1/1996 | Smith |
| 5,595,200 | A | 1/1997 | Favaro |
| 5,657,878 | A | 8/1997 | Austin |
| 5,860,716 | A | 1/1999 | Good et al. |
| 5,971,513 | A | 10/1999 | Cassalia |
| 6,247,771 | B1 | 6/2001 | Miller |
| 6,571,808 | B2 | 6/2003 | Todd |
| 6,755,490 | B2 | 6/2004 | Welch et al. |
| 6,974,040 | B2 | 12/2005 | Jahrling |
| 7,032,604 | B2 | 4/2006 | Welch |
| 7,137,397 | B2 | 11/2006 | Rosenbauer et al. |
| 7,168,578 | B2 | 1/2007 | Mersch et al. |
| 7,410,228 | B2 | 8/2008 | Dickson et al. |
| 7,418,967 | B2 | 9/2008 | Kim |
| 7,424,893 | B2 | 9/2008 | Kim |
| 7,651,180 | B2 | 1/2010 | Deiss et al. |
| 7,775,378 | B2 | 8/2010 | Tynes et al. |
| 8,813,766 | B2 | 8/2014 | Bhajak et al. |
| 9,596,975 | B2 | 3/2017 | Bhajak et al. |
| 9,681,792 | B2 | 6/2017 | Bhajak et al. |
| 2005/0001524 | A1 | 1/2005 | Deiss et al. |
| 2005/0039782 | A1 | 2/2005 | Kim |
| 2006/0119236 | A1 | 6/2006 | Dickson et al. |
| 2007/0035220 | A1 | 2/2007 | Bond et al. |
| 2007/0215187 | A1 | 9/2007 | Koch et al. |
| 2008/0011337 | A1 | 1/2008 | Ryu et al. |
| 2008/0129168 | A1 | 6/2008 | Banta et al. |
| 2008/0272072 | A1 | 11/2008 | Tynes et al. |
| 2009/0009040 | A1 | 1/2009 | Dellby et al. |
| 2009/0050186 | A1 | 2/2009 | Kim et al. |
| 2010/0314977 | A1* | 12/2010 | Mallory ..... A47L 15/503 312/228.1 |
| 2012/0082507 | A1 | 4/2012 | Wong et al. |
| 2012/0291824 | A1 | 11/2012 | Bhajak et al. |
| 2012/0291825 | A1 | 11/2012 | Bhajak et al. |
| 2017/0127906 | A1 | 5/2017 | Bhajak et al. |

FOREIGN PATENT DOCUMENTS

| | | | |
|---|---|---|---|
| JP | 0489025 | A | 3/1992 |
| KR | 100846263 | B1 | 7/2008 |
| KR | 20090007094 | A | 1/2009 |
| WO | 200049936 | | 8/2000 |
| WO | 200249495 | A1 | 6/2002 |
| WO | 2008038320 | A1 | 4/2008 |

* cited by examiner

HEIGHT ADJUSTER MECHANISM FOR A DISHWASHER DISH RACK

CROSS-REFERENCE TO RELATED APPLICATIONS

This application is a continuation of U.S. patent application Ser. No. 15/413,971, filed Jan. 24, 2017, now U.S. Pat. No. 10,342,408, which is a divisional of U.S. patent application Ser. No. 14/574,439, now U.S. Pat. No. 9,596,975, which is a continuation-in-part of U.S. patent application Ser. No. 14/458,661, now U.S. Pat. No. 9,681,792, which is a divisional of U.S. patent application Ser. No. 13/110,048, now U.S. Pat. No. 8,813,766, all of which are entitled "HEIGHT ADJUSTER MECHANISM FOR A DISHWASHER DISH RACK." The entire disclosures of each are incorporated herein by reference.

FIELD OF THE INVENTION

The present invention pertains to the art of dishwashers and, more particularly, to a vertical height adjuster mechanism for a dishwasher dish rack.

DESCRIPTION OF THE RELATED ART

A front loading dishwasher typically includes a tub having an open front. The tub defines a washing chamber into which items, such as kitchenware, glassware and the like, are placed to undergo a washing operation. The dishwasher is generally provided with a door, pivotally mounted to the tub, that closes the open front, and upper and lower extensible dish racks for supporting items during the washing operation. Typically, the upper and lower dish racks are separated by a defined vertical spacing that limits the overall size of items that can be placed in the dishwasher.

In order to provide more flexibility to consumers, manufacturers have developed adjustment mechanisms that enable at least one dish rack to be vertically adjustable. Most commonly, the upper dish rack can be vertically shifted to increase the defined vertical spacing between the upper and lower dish racks. Typically, the adjustment mechanisms are mounted on opposing sides of the dish rack and connect to extensible support rails that permit the dish rack to move in and out of the washing chamber. In most cases, the adjustment mechanisms have complicated structure. In addition, the latching mechanisms used by prior art adjustment mechanisms can be difficult to operate. Hidden buttons, sticky latches, and the like can make it difficult to transition from one height position to another. In some cases, the adjustment mechanisms are unstable.

Based on the above, there still exists a need in the art for a vertical height adjustment mechanism for a dishwasher dish rack. More specifically, there exists a need for a vertical height adjustment mechanism that is cost effective to manufacture and easy to use.

SUMMARY OF THE DISCLOSURE

The present invention is generally directed to a dishwasher including an open front tub that defines a washing chamber, a door pivotally mounted relative to the tub for closing the washing chamber and a dish rack for supporting items to be washed in the washing chamber. The dish rack is mounted to horizontally extensible support members that permit the dish rack to be shifted in and out of the washing chamber. In accordance with the invention, the dish rack is provided with an adjustment mechanism that enables the dish rack to also be vertically shifted between first and second positions. More specifically, the adjustment mechanism includes at least one control arm which extends along a front portion of the rack for conveniently, manually shifting the rack between desired vertical positions.

In accordance with a preferred embodiment of the invention, the adjustment mechanism includes a base member including a lower body portion movably connected to the extensible support member carried by the tub and an upright body portion, a shiftable support body fixed for concurrent movement to the rack and slidably receiving the upright body portion of the base member, and the at least one control arm which includes side levers extending along and pivotally mounted to respective sides of the rack and at least one frontal cross bar. Manually, vertically shifting of the control arm from the front of the rack causes the side levers to pivot and shift the extensible support relative to the base member, thereby vertically repositioning the rack. A latching mechanism is employed to selectively maintain the rack in a desired vertical position.

In accordance with the invention, the control arm can be constituted by: a single, generally U-shaped arm with the cross bar interconnecting both of the side levers; multiple, generally L-shaped arms arranged on each side of the rack such that separate front cross bars are provided for manual engagement by both hands of a user simultaneously; or a U-shaped arm formed from multiple, interconnected pieces. In addition, the latching mechanism can also take various forms, including single or multiple, pivoting latching elements.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
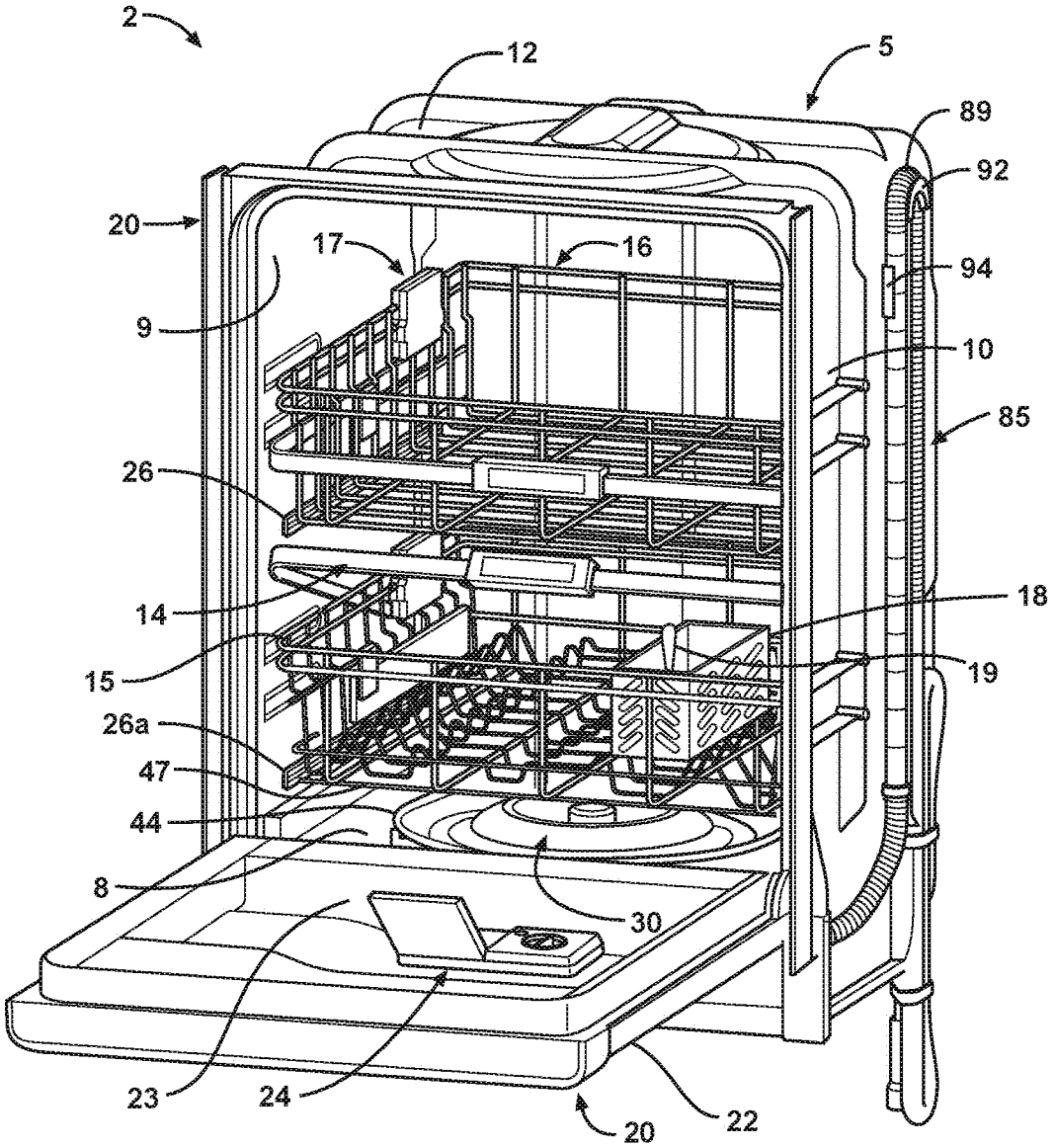
FIG. 1 is a perspective view of a dishwasher incorporating a dish rack having a vertical height adjustment mechanism constructed in accordance with the present invention.

With initial reference to FIG. 1, a dishwasher constructed in accordance with the present invention is generally indicated at 2. As shown, dishwasher 2 includes a tub 5, which is preferably injection molded of plastic, so as to include integral bottom, side, rear and top walls 8-12 respectively. Within the confines of walls 8-12, tub 5 defines a washing chamber 14 within which soiled kitchenware is adapted to be placed on an adjustable lower dish rack 15 which, as will be detailed more fully below, includes an adjustment mechanism 17*a* for vertically shifting dish rack 15 between a first or home position and a second or raised position and/or an adjustable upper dish rack 16 which, as will be detailed more fully below, includes an adjustment mechanism 17 for vertically shifting dish rack 16 between a first or home position and a second or raised position. As shown in this figure, a utensil basket 18, which contains a utensil 19, is preferably positioned within lower rack 15. Tub 5 has associated therewith a frontal portion 20 at which is pivotally supported a door 21 used to seal washing chamber 14 during a washing operation. Door 21 has an exterior panel 22 and an interior panel 23 preferably provided with a dispensing assembly 24 within which a consumer can place liquid or particulate washing detergent for dispensing at predetermined periods of the washing operation.

In a manner known in the art, upper dish rack 16 is horizontally shiftable between a first position wherein upper dish rack 16 is entirely within the confines of washing chamber 14 and a second position, wherein upper dish rack 16 extends, at least partially outward, from washing chamber 14. Toward that end, dishwasher 2 is provided with upper extensible support members, one of which is indicated generally at 26. In a similar manner, lower dish rack 15 is selectively, horizontally shiftable between first and second positions. Toward that end, dishwasher 2 is also provided with lower extensible support members, one of which is generally indicated at 26*a*.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheathed, electric resistance-type heating element. In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. As the exact structure and operation of pump and filter assembly 30 of dishwasher 2 is not part of the present invention, it will not be discussed further herein. Instead, the present invention is directed to particulars of height adjustment mechanisms 17 and 17*a*.

Figure 2:
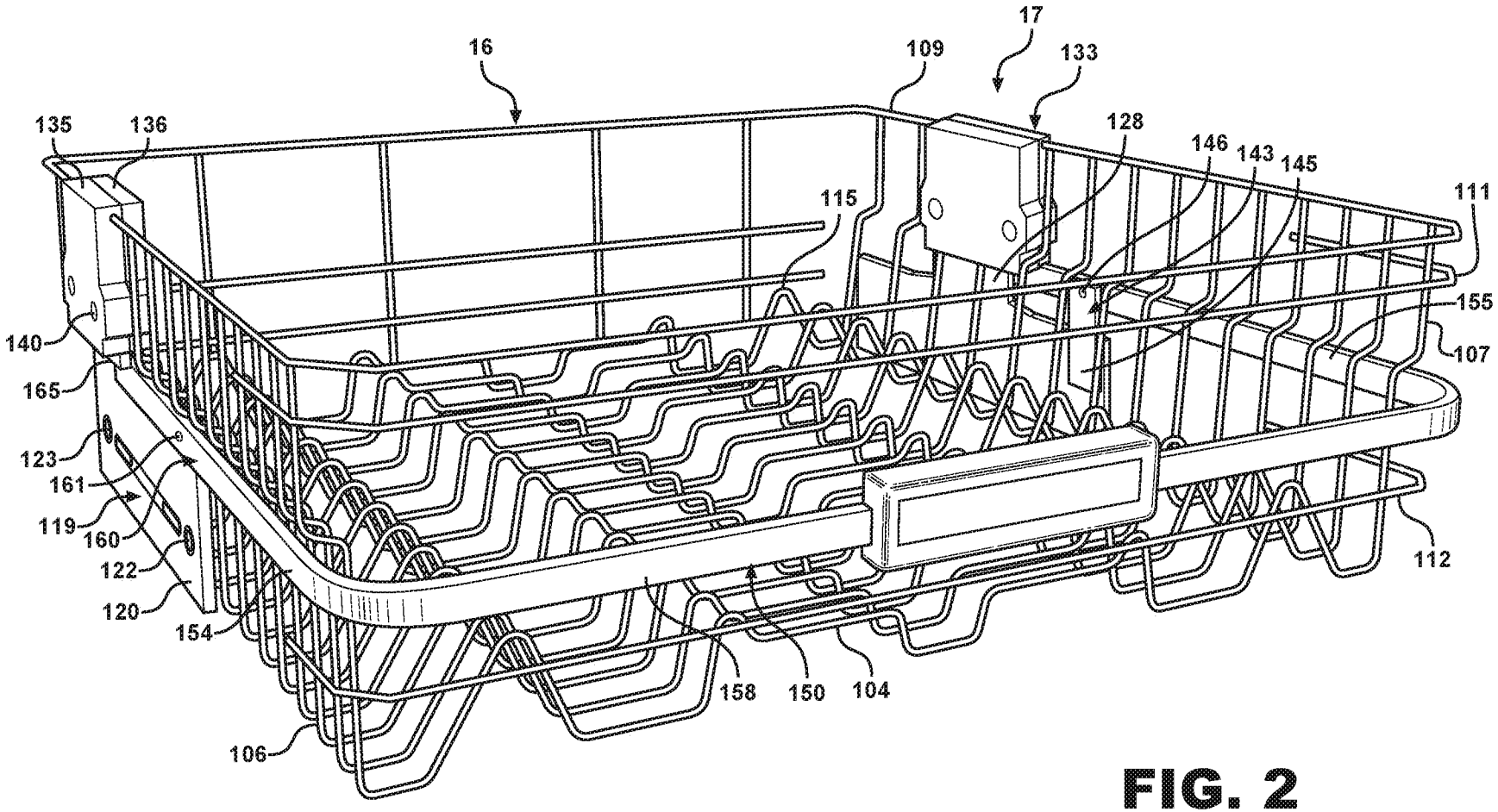
FIG. 2 is a perspective view of the dish rack with the height adjustment mechanism from the dishwasher of FIG. 1.
Figure 3:
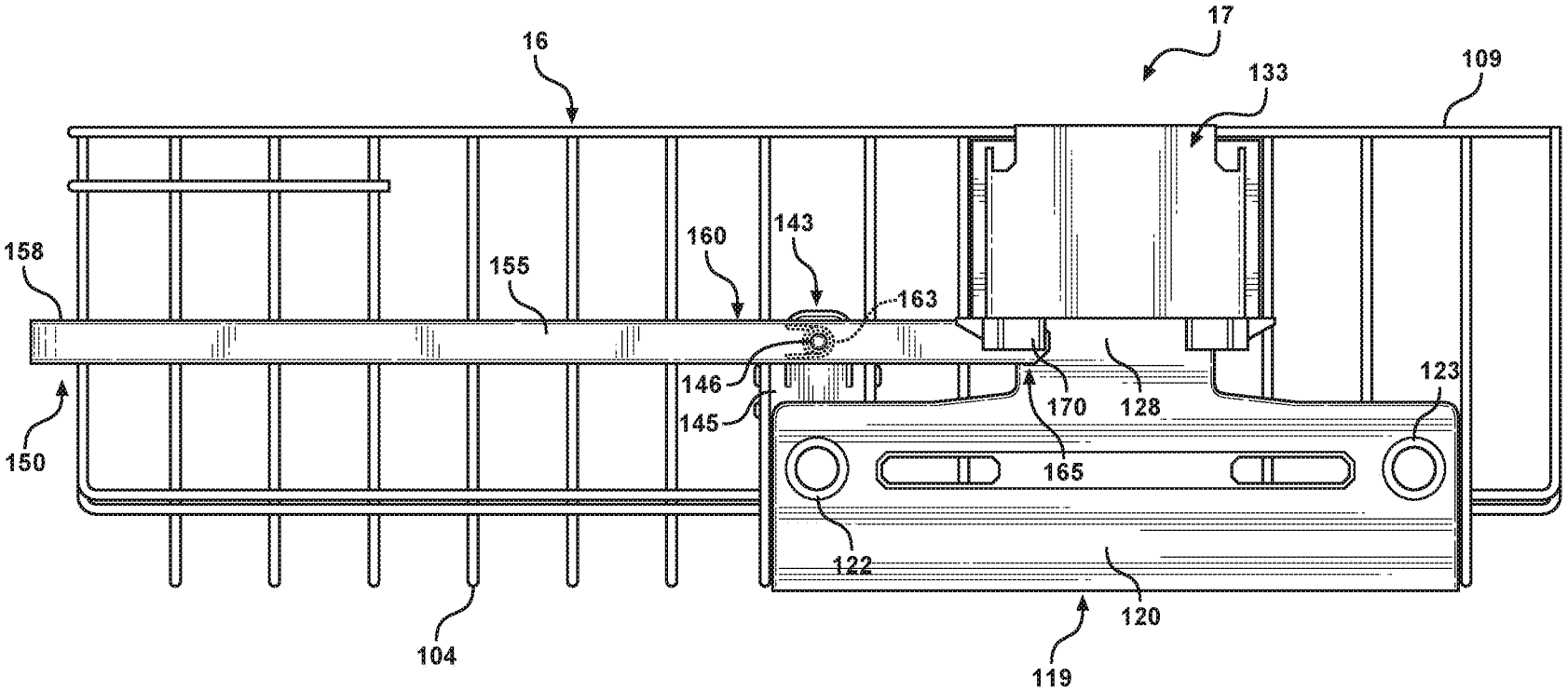
FIG. 3 is an elevational side view of the rack with the height adjustment mechanism of FIG. 2.

Reference will now be made to FIGS. 2 and 3 in describing the particular details of height adjustment mechanism 17 and its connection to rack 16. In the exemplary embodiment shown, rack 16 is formed of interconnected wires so as to define a plurality of bottom rails 104 which extend up and define opposing side rails 106, 107. Also shown in an upper peripheral rim rail 109 and a plurality of lower peripheral rails 111, 112. Bottom rails 104 have portions thereof which define multiple levels for rack 16 and are formed with various raised rail portions, such as that indicated at 115, to more readily support various kitchenware items in a manner known in the art. In general, the particular construction and design of rack 16 can greatly vary in accordance with the invention and is known in the art. At this point, it is simply important to note that rack 16 includes bottom, side, rear and front walls (not separately labeled).

Height adjusting mechanism 17 of the invention is shown to include a base member 119 having a lower body portion 120 including mounts 122 and 123 for rotatably supporting a pair of fore-aft-spaced wheels (not shown) which interact with support members 26 carried by tub 5 in order to enable rack 16 to be shifted into and out of washing chamber 14 in a manner widely known in the art. Base member 119 also includes an upright or upper body portion 128 which is received within a shiftable support body 133. More specifically, shiftable support body 133 includes an outer body 135 and an inner body member 136 which combine to clamp upon a respective set of side rails 106, 107 and which are secured together by screws indicated at 140. At this point, it should be recognized that a separate base member 119 and shiftable support body 133 are provided on each of side rails 106, 107 such that the overall height adjustment mechanism 17 can be readily understood from considering the structure and function of one side. In addition, height adjustment mechanism 17 includes a pair of pivot support brackets, one of which is indicated at 143. Each of pivot support brackets 143 includes a plate 145 that is either integrally formed with or rigidly secured to base member 119, as well as a pivot pin 146 projecting from plate 145. Finally, height adjustment mechanism 17 includes at least one control arm generally indicated at 150. In this embodiment, control arm 150 includes a pair of side levers 154 and 155 which are integrally formed with a frontal cross bar 158. Each side lever 154, 155 had an intermediate section 160 provided with an aperture 161 receiving a respective pivot pin 146. With this arrangement, control arm 150 is generally U-shaped and pivotally mounted to base member 119 for movement about a pivot axis defined by aligned pins 146 by the manual manipulation of cross bar 158. A spring 163 (see FIG. 3) is preferably positioned between each intermediate section 160 and a respective pivot support bracket 143. In this embodiment, spring 163 preferably constitute a torsion spring which biases frontal cross bar 158 in a downward or lowered condition. Each side lever 154, 155 also includes a terminal section 165 which abuts shiftable support body 133 and preferably is laterally retained by a locating element 170 extending from shiftable support body 133.

With this arrangement, it should be realized that the interengagement between each base member 119 with a respective support member 26 prevents base member 119 from shifting vertically relative to tub 5, while still enabling each base member 119 to move into and out of washing chamber 14. In addition, each pivot support bracket 143 is fixed to base member 119 and therefore also does not shift vertically. However, the clamping or sandwiching of side rails 106, 107 by the shiftable support bodies 133 enables rack 16 and the shiftable support bodies 133 to move vertically relative to base members 119. Since the upright body portion 128 of each base member 119 extends within a respective shiftable support body 133, each support body 133 is guided for vertical movement relative to its base member 119. With the pivotal mounting of control arm 150 and the engagement of each terminal section 165 with a respective shiftable support body 133, the lowering of frontal cross bar 158 will cause terminal section 165 to be raised, hence, raising both shiftable support bodies 133 and rack 16 relative to base members 119 and tub 5. In accordance with the invention, it is considered particularly advantageous that cross bar 158 extends along the front wall of rack 16 (entirely across the front wall in this embodiment) such that it is readily accessible from the front of dishwasher 2 as will become more fully evident below. It should also be recognized that, with the inclusion of springs 163, control arm 150 is biased into the substantially horizontal configuration shown in these figures such that, after being manipulated by a user to adjust the height of rack 16, control arm 150 will be automatically repositioned.

In accordance with the present invention, the particular number of vertical positions which can be established by rack 16 can vary greatly. In its simplest form, the invention contemplates just upper and lower positions, with the lower position being represented in FIGS. 2 and 3 wherein each shiftable support body 133 is bottomed out on a corresponding upper body portion 128 of base member 119 as detailed more fully below. More importantly, it is necessary to incorporate a form of latching to maintain rack 16 in any desired raised position. Although various different latching mechanisms or assemblies could be employed, reference will now be made to FIGS. 4-10.

As illustrated in these embodiments, a cross-section of shiftable support body 133 is depicted with upright body portion 128 extending therein. Internally, shiftable support body 133, which is preferably molded of plastic, is provided with a series of vertically spaced, internal ribs 180-186. Interconnected with rib 185 are screw posts 189 and 190 through which screws 140 extend. Rib 181 is formed with an extension 193 as discussed further below. Upright body portion 128 has lateral edges 196 and 197 closely spaced from internal ribs 182-186 and an in-turned end portion 199. In-turned end portion 199 is formed with fore-to-aft spaced notched regions 204 and 205 which define ledges 208 and 209 respectively. When rack 16 is in its lowered position, extension 193 of internal rib 181 sets upon ledges 208 and 209.

Mounted to in-turned end portion 199 is a latch housing 215. More specifically, latch housing 215 is secured to in-turned end portion 199 by means of a screw 217. Latch housing 215 includes a lower housing portion 219 from which projects a pivot pin 221 which rotatably supports a latch element 224. Latch element 224 includes first and second end portions (not separately labeled), each of which is formed with a groove 228, 229. Latch housing 215 also includes an upper housing portion 233 that carries a spring 235 within a bore 238. Spring 235 acts upon a ball 241 in order to bias ball 241 against latch element 224. Certainly, ball 241 will have a tendency to become seated in one of grooves 228 and 229 to retain latch element 224 in selected positions such that this overall ball and groove structure establishes a detent arrangement. At this point, it should be realized that these figures also set forth a cross-section of latch housing 215 such that latch element 224 is preferably internally disposed, while latch housing 215 includes a side slot indicated at 244 through which a portion of latch element 224 can project. The latching mechanism of the invention also includes a retainer element 253 which is formed integral with shiftable support body 133 so as to be vertically shiftable in unison with rack 16. In the embodiment depicted, retainer element 253 is shown to include an annular body 256 having a central opening 258 sized to receive latch housing 215.

Figure 4:
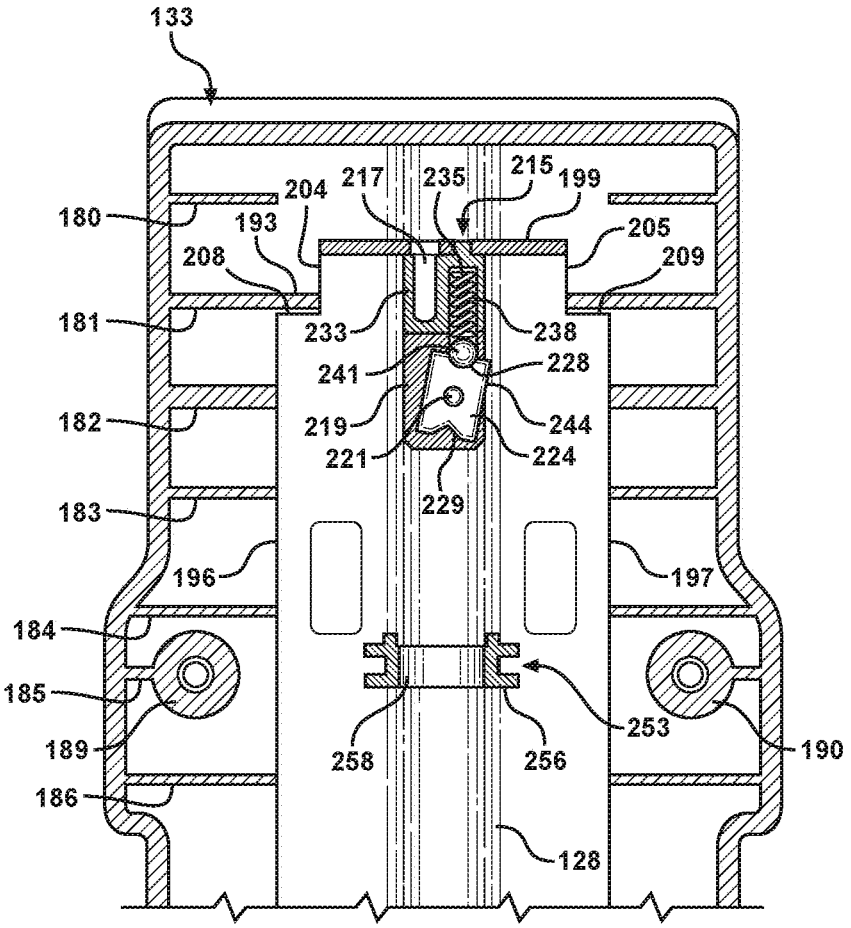
FIG. 4 is a partial cross-sectional view of part of the height adjustment mechanism of FIG. 3 illustrating a latching mechanism constructed in accordance with a first embodiment of the invention and the rack in a lowermost portion.
Figure 5:
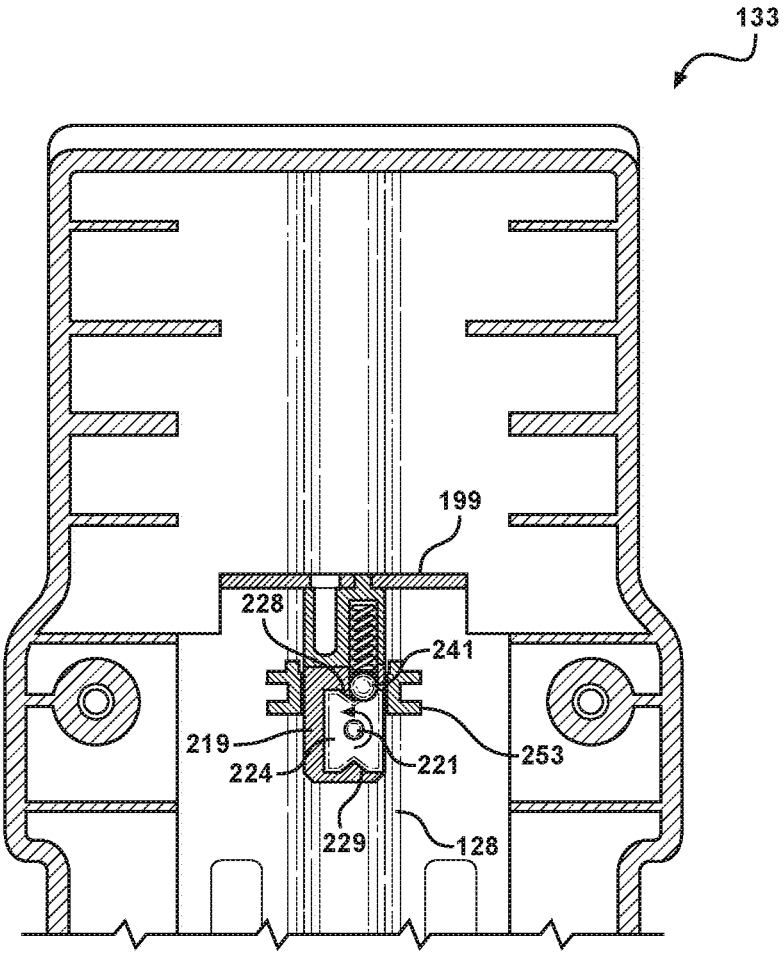
FIGS. 5-10 present partial cross-sectional views similar to FIG. 4 with the height adjustment and latching mechanisms being progressively shifted from the lowermost rack position to an uppermost rack position.
Figure 7:
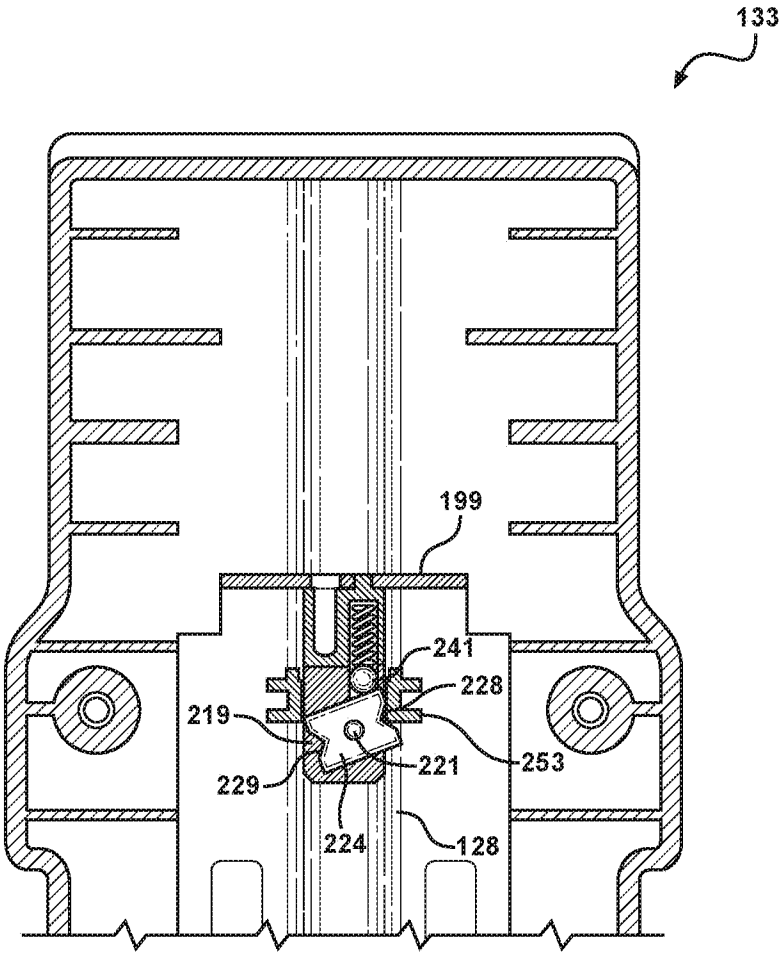
Figure 6:
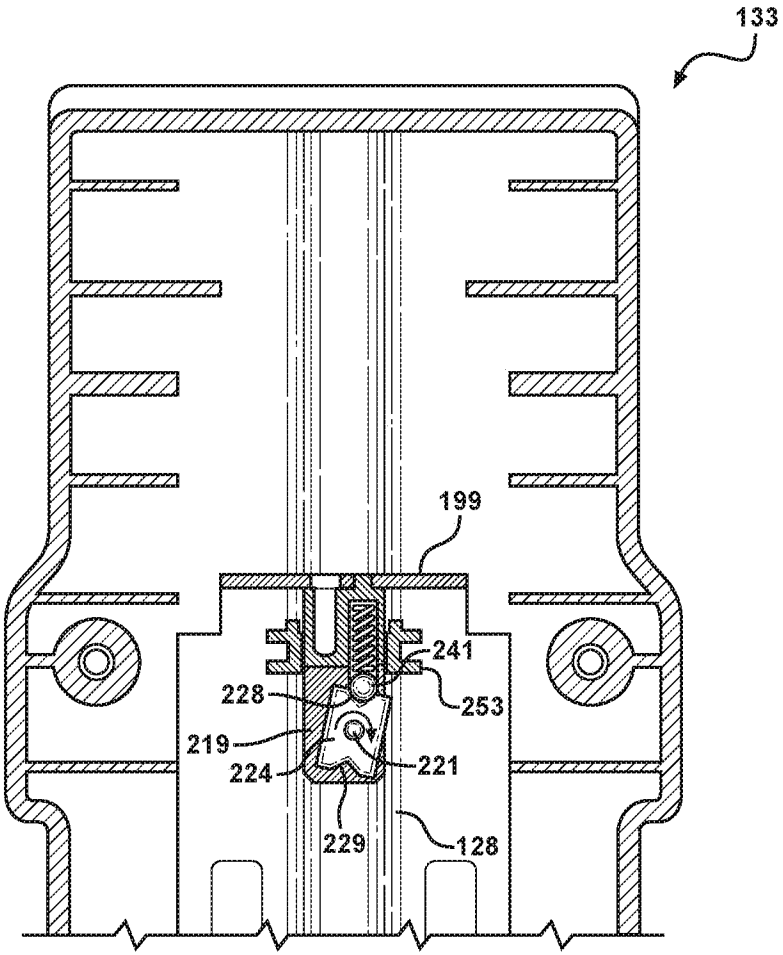

As stated above, FIG. 4 represents rack 16 in its lowered position wherein retainer element 253 is spaced vertically below latch housing 215. Upon the grasping and lowering of frontal cross bar 158, control arm 150 will pivot about pins 146 such that shiftable support bodies 133 and rack 16 will be lifted vertically upward as represented in FIG. 5 wherein latch housing 215 has been received within central opening 258 of annular body 256 and retainer element 253 has caused latch element 224 to rotate counterclockwise about pivot pin 221, while ball 241 has ridden upon groove 228 against the biasing force of spring 235. Once retainer element 253 clears latch element 224 as shown in FIG. 6, latch element 224 will rotate clockwise with ball 241 again being received in groove 228. Thereafter, rack 16 will be lowered which causes retainer element 253 to again engage latch element 224 and rotate the same until the position shown in FIG. 7 is reached. In this position, latch element 224 reaches a binding point and rack 16 is maintained in a desired, raised position.

Figure 9:
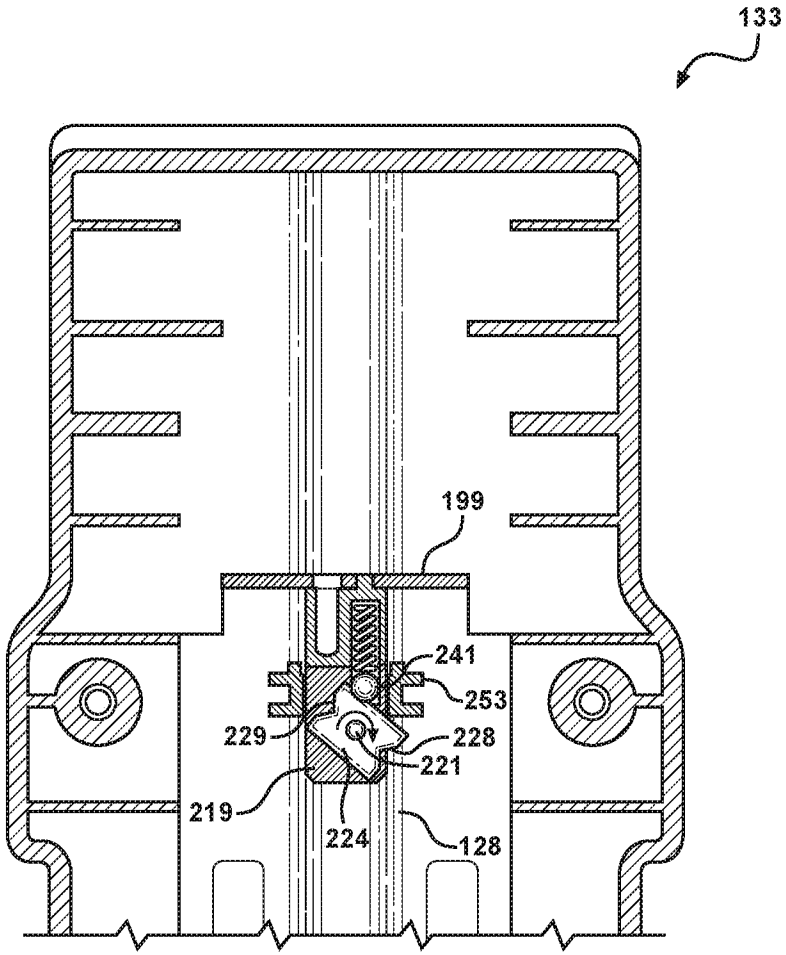
Figure 8:
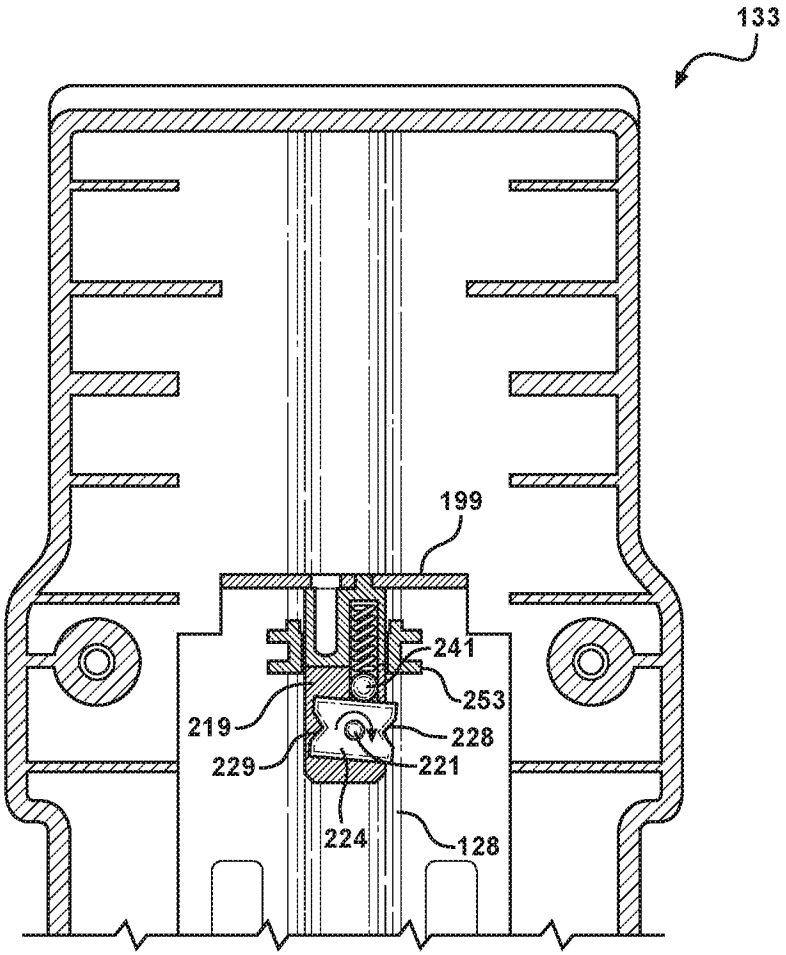
Figure 10:
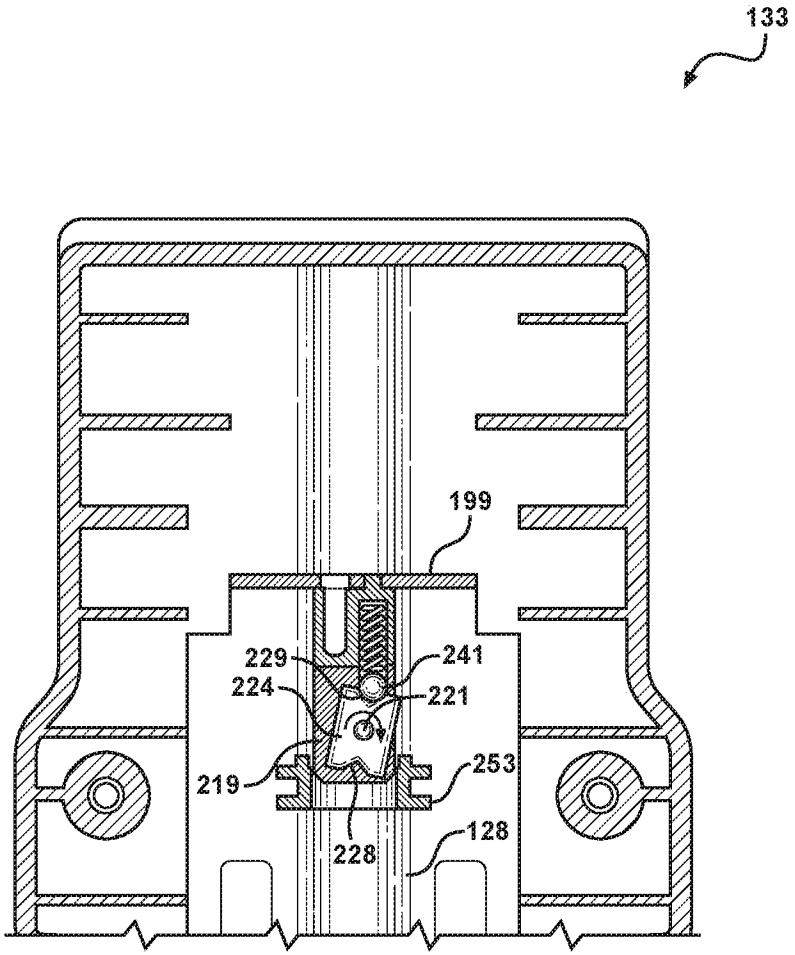

When it is desired to lower rack 16, control arm 150 is again engaged to slightly raise rack 16 from the position shown in FIG. 7 to that shown in FIG. 8 wherein retaining element 253 is located above latch element 224 and latch element 224 is caused to further rotate clockwise due to the engagement with ball 241 and the biasing of spring 235. Rack 16 can then be lowered. During the lowering process, retainer element 253 will initially engage latch element 224 and cause the same to rotate clockwise as depicted in FIG. 9. As rack 16 is further lowered, retainer element 253 will continue to rotate latch element 224 until ball 241 is received within groove 229 as shown in FIG. 10. At this point, retainer element 253 will clear latch housing 215 and rack 16 can readily assume the position shown in FIG. 4 such that rack 16 can again be selectively re-raised in the same manner described above.

As indicated above, frontal cross bar 158 can be used to raise rack 16 in accordance with the present invention with various different latching mechanisms. By way of another example, reference is made to FIGS. 11-19 which illustrate a second latching mechanism embodiment wherein like reference numerals refer to corresponding parts with that described above. In accordance with this embodiment, each shiftable support body 133 is formed with a side slot 268 through which extends terminal section 165 of a respective side lever 154, 155. Instead of retainer element 253 in the form of a ring, this embodiment employs a retainer element 270 in the form of a pin or rod. As with retainer element 253, retainer element 270 is fixed for movement with both shiftable support body 133 and rack 16. Also in accordance with this embodiment, mounted upon upper body portion 128 of base member 119 is a first latch element or arm 276 and a second latch element or arm 277. As shown labeled on latch arm 276, each latch arm 276, 277 includes a first end 279 which is pivotally mounted through a pin 280 to upper body portion 128, and a second end 281 remote from pin 280.

Figure 11:
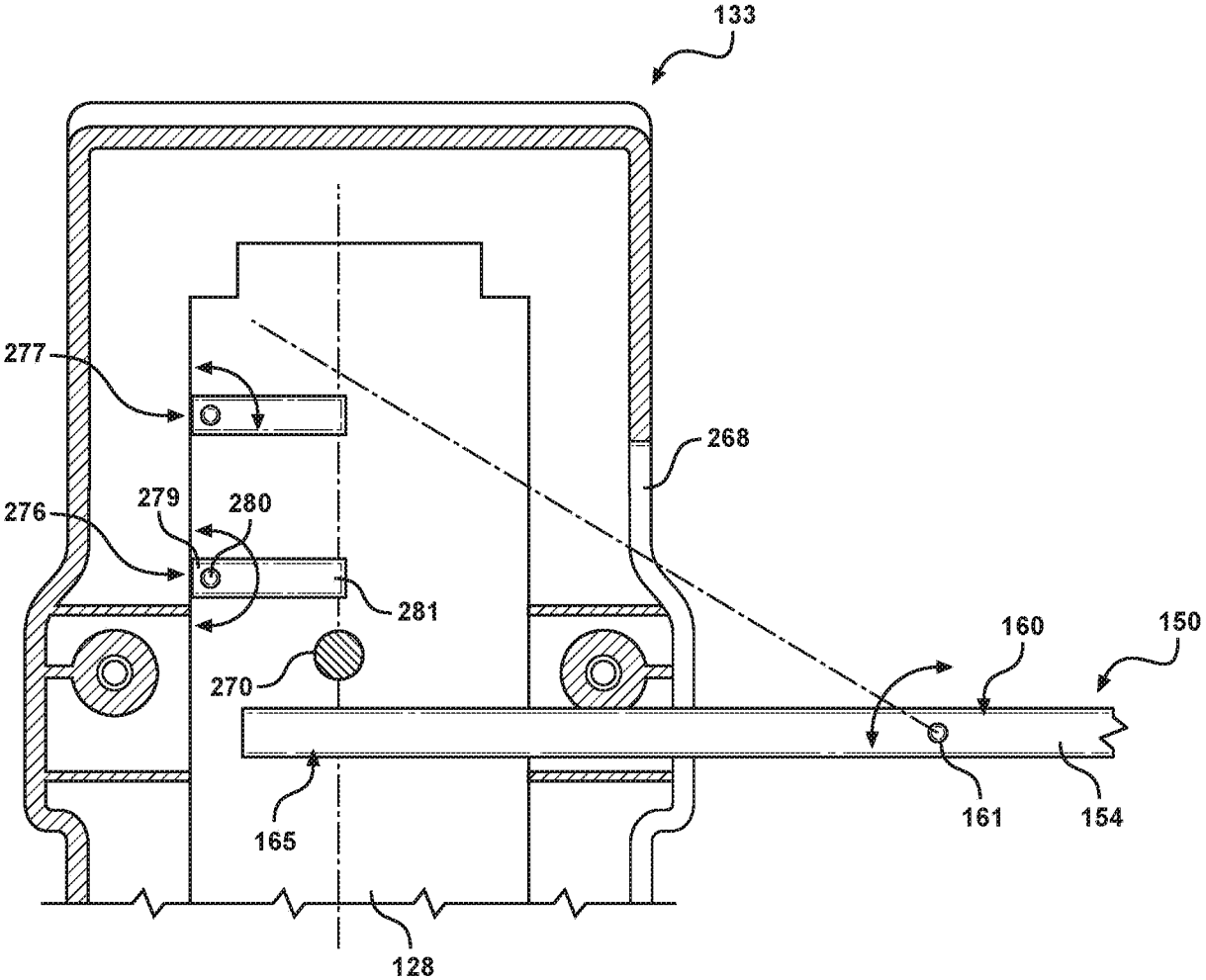
FIGS. 11-19 set forth cross-sectional views of a height adjustment mechanism with a latching mechanism constructed in accordance with a second embodiment of the invention, shown through various vertically varying operational positions.
Figure 12:
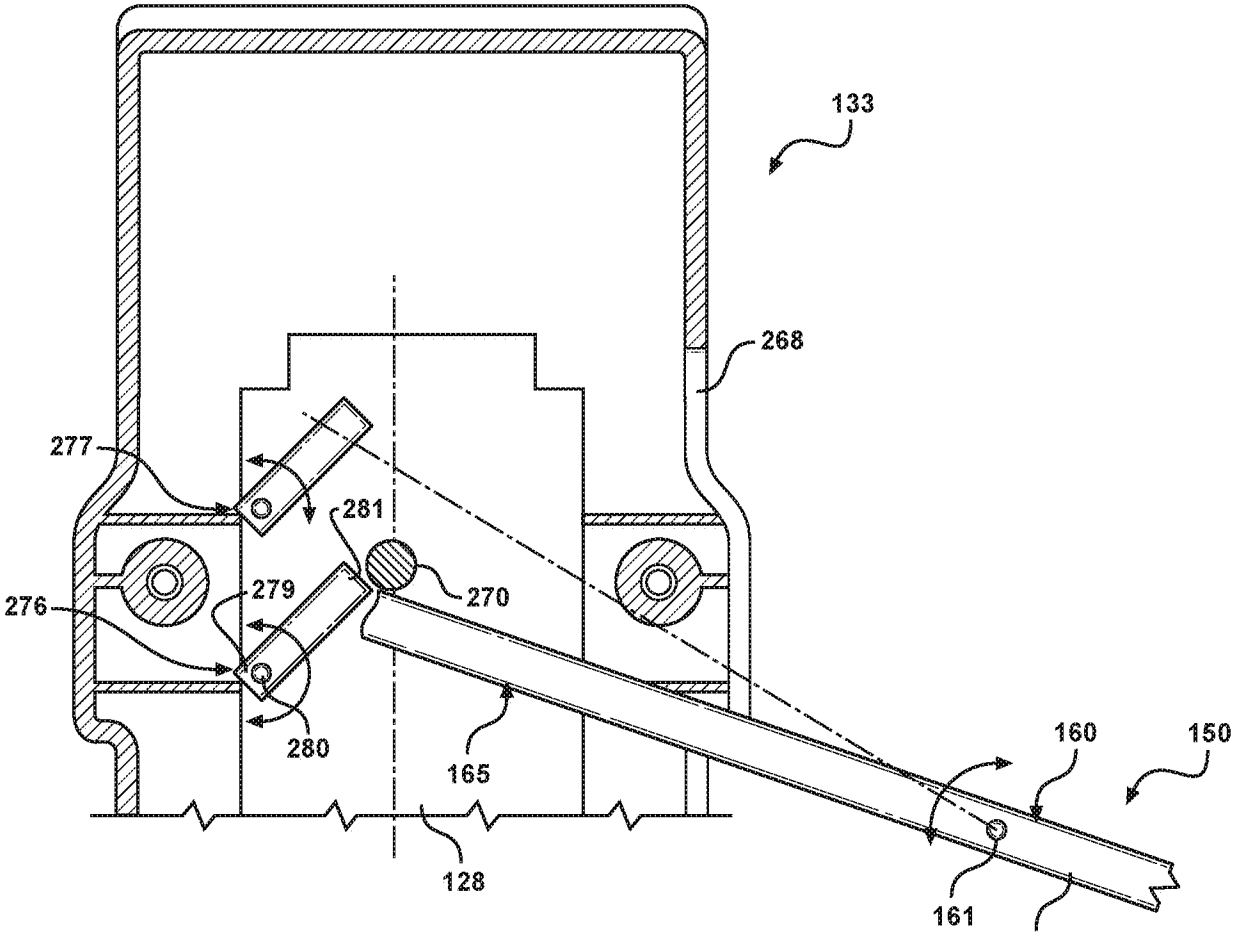
Figure 13:
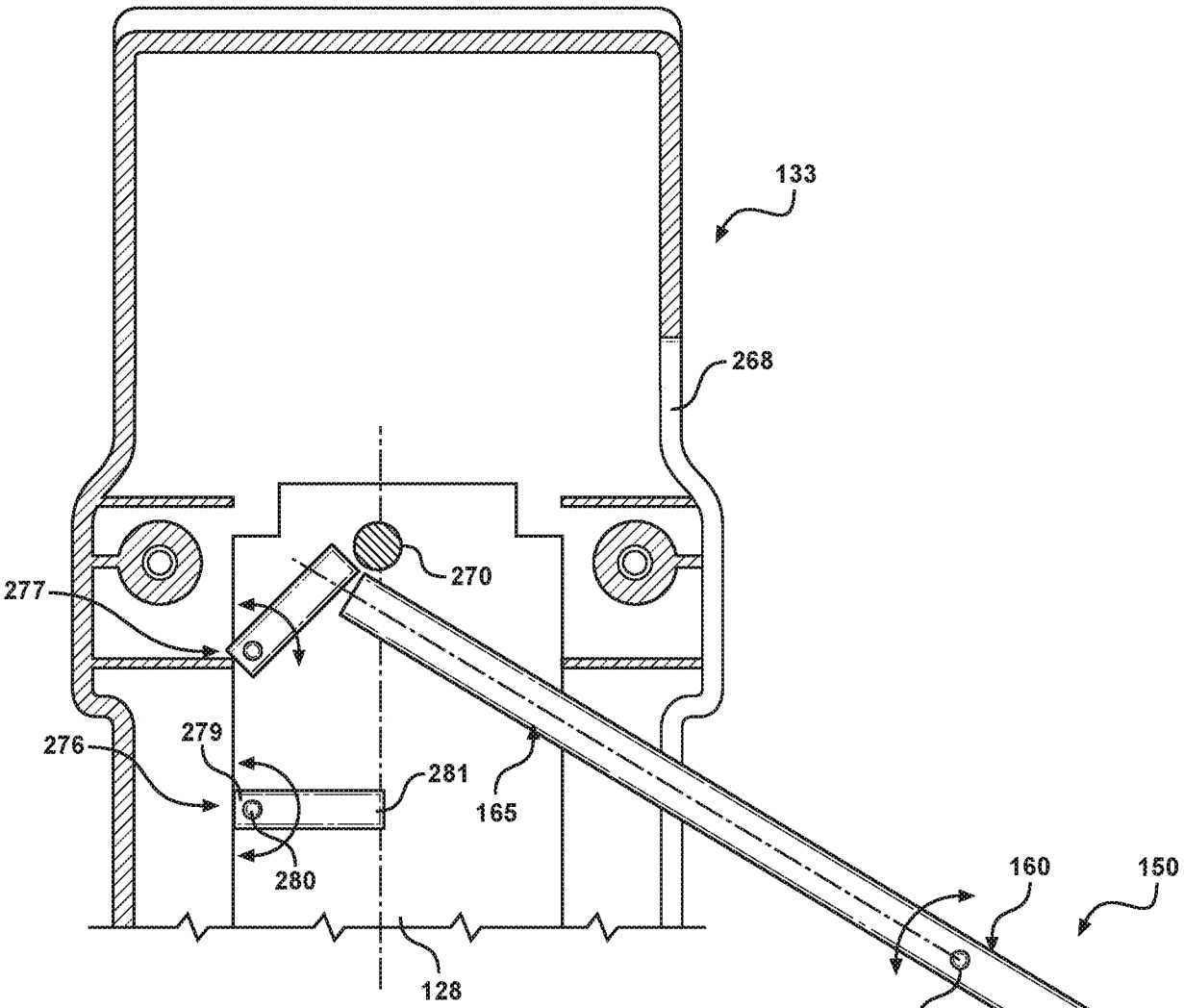
Figure 14:
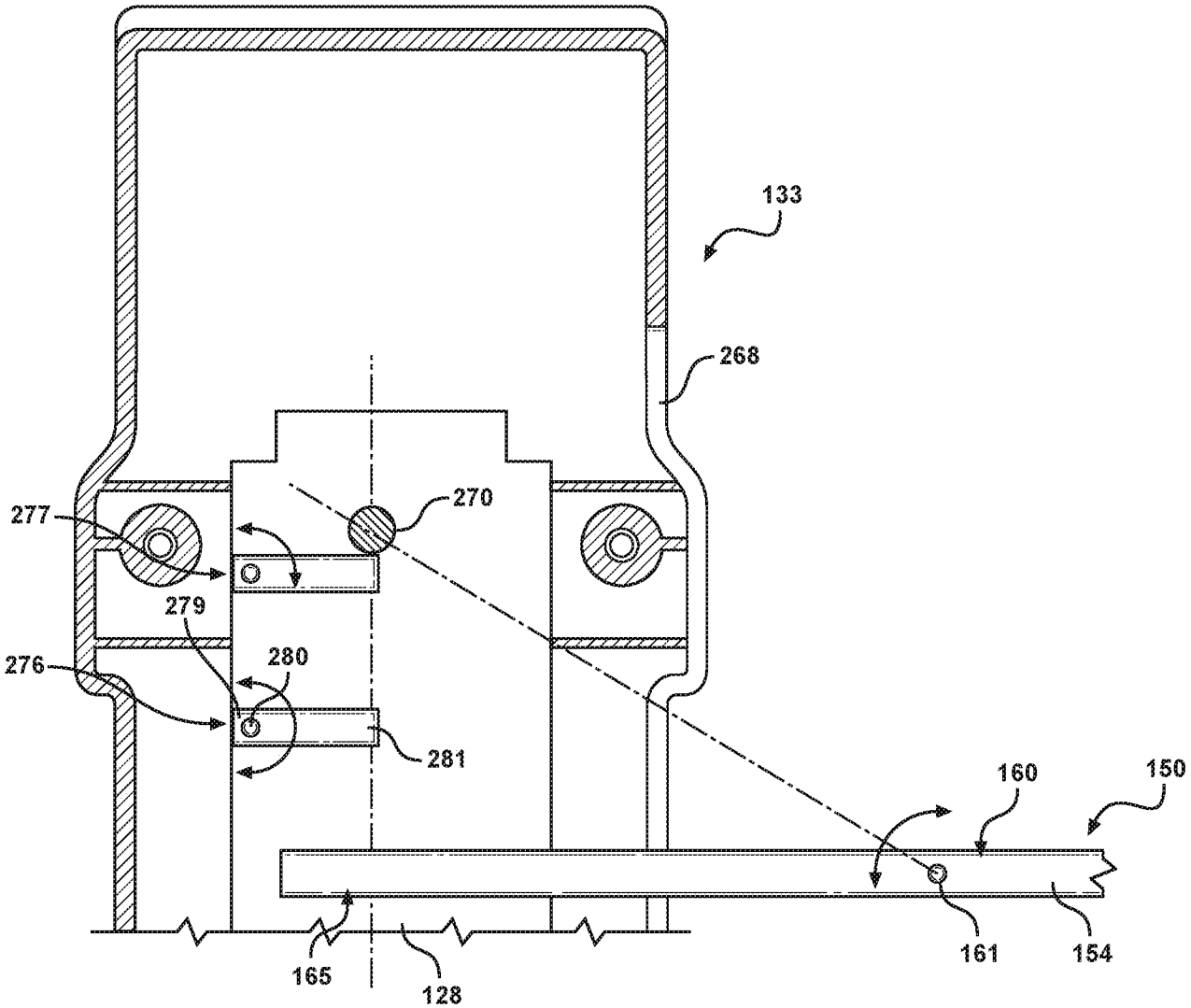

FIG. 11 shows the relative positioning between the various components of rack 16 in its lowermost position. When it is desired to raise rack 16, control arm 150 is again manually grasped and lowered from the rack 16 to cause the same to pivot about pins 146 such that terminal sections 165 are raised. Upon raising, each terminal section 165 engages a respective retainer element 270 and lifts the same. Initially, retainer element 270 will abut first latch arm 276 and cause the same to rotate upward as shown in FIG. 12. Although not depicted, first latch arm 276 and second latch arm 277 are interconnected such that rotation of first latch arm 276 will also cause second latch arm 277 to rotate as clearly shown in FIG. 12. This connection can take various mechanical forms, such as a suitable gearing or belt drive arrangement. However, it is important to note that first latch arm 276 is permitted to rotate through 180 degrees represented by the arrows in this figure, while second latch arm 277 can only rotate through 90 degrees. In any case, continued raising of control arm 150 (which is shown broken off at terminal end 165 for clarity of the drawing) causes retainer element 270 to extend above second latch arm 277 as represented in FIG. 13. Thereafter, control arm 150 can be lowered and retainer element 270 will be supported upon first latch arm 276 as represented in FIG. 14.

Figure 15:
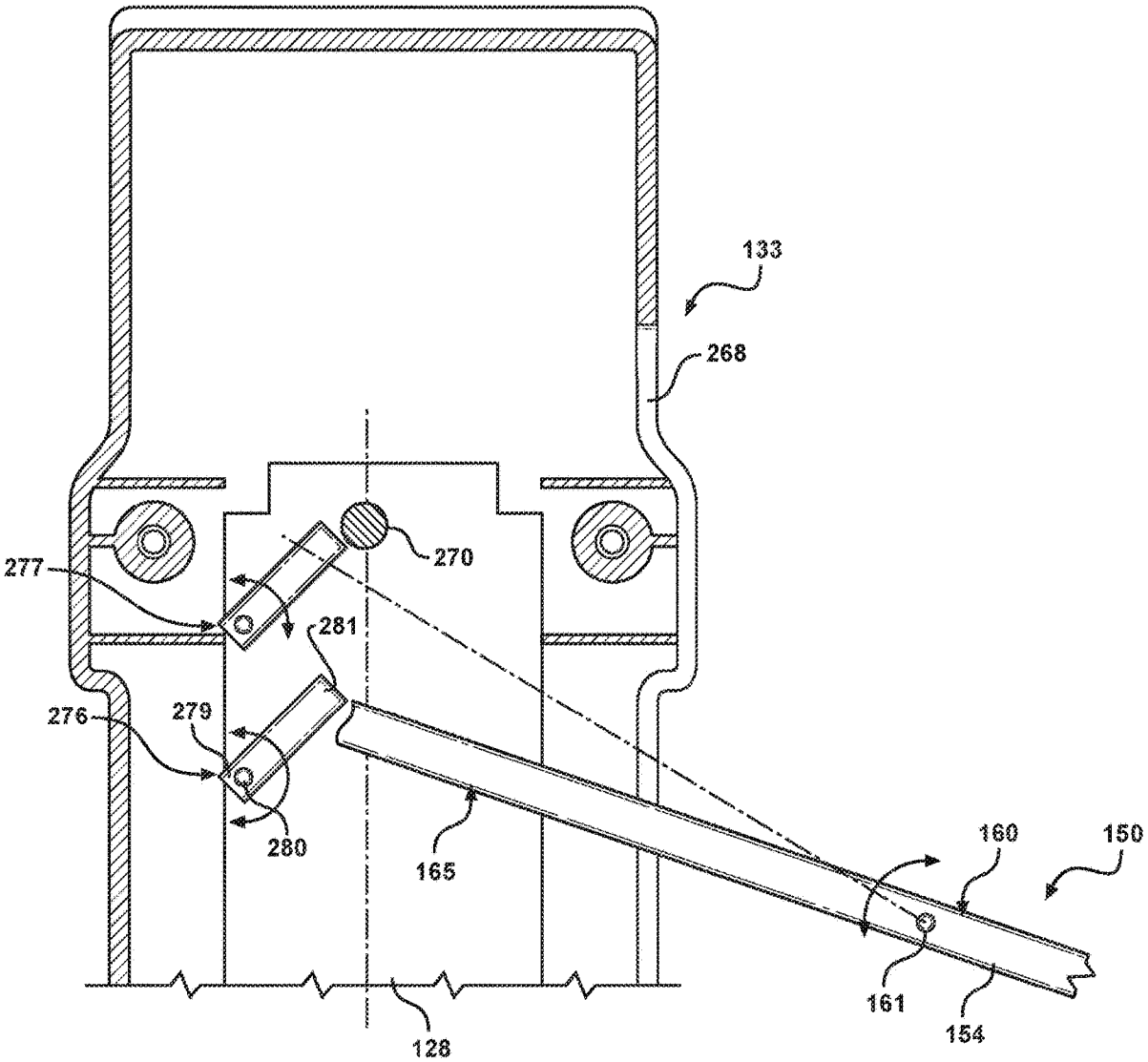
Figure 16:
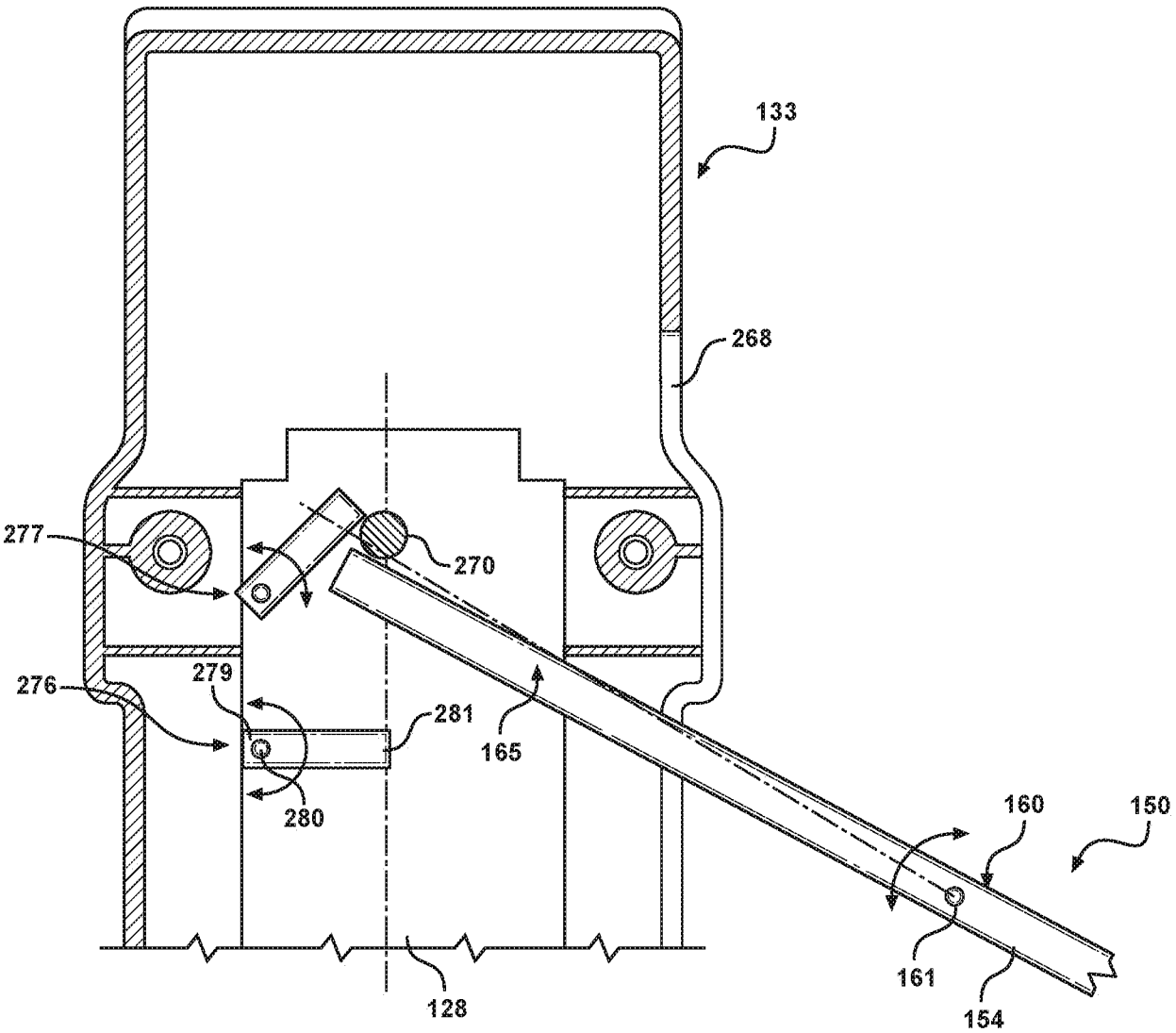
Figure 17:
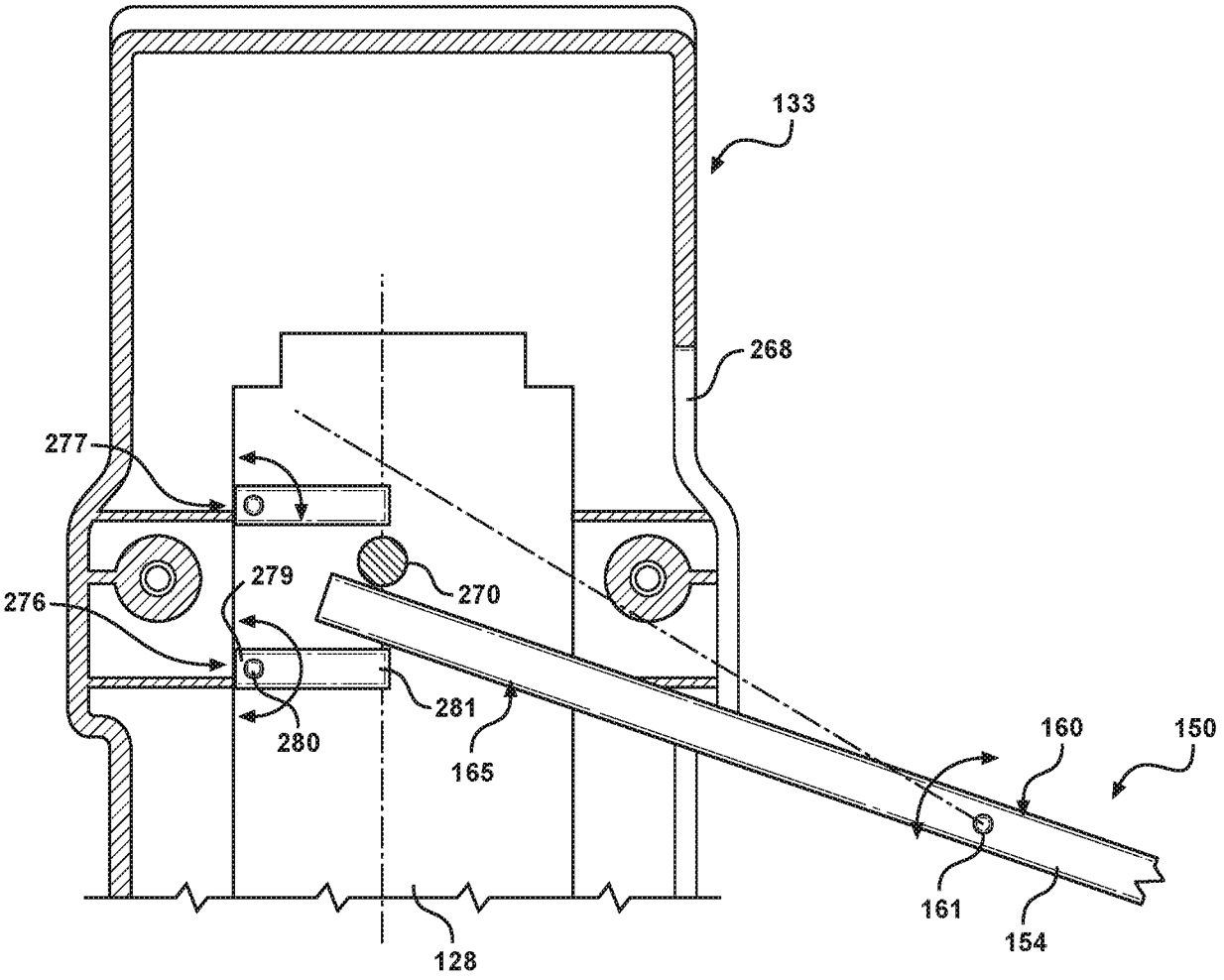
Figure 18:
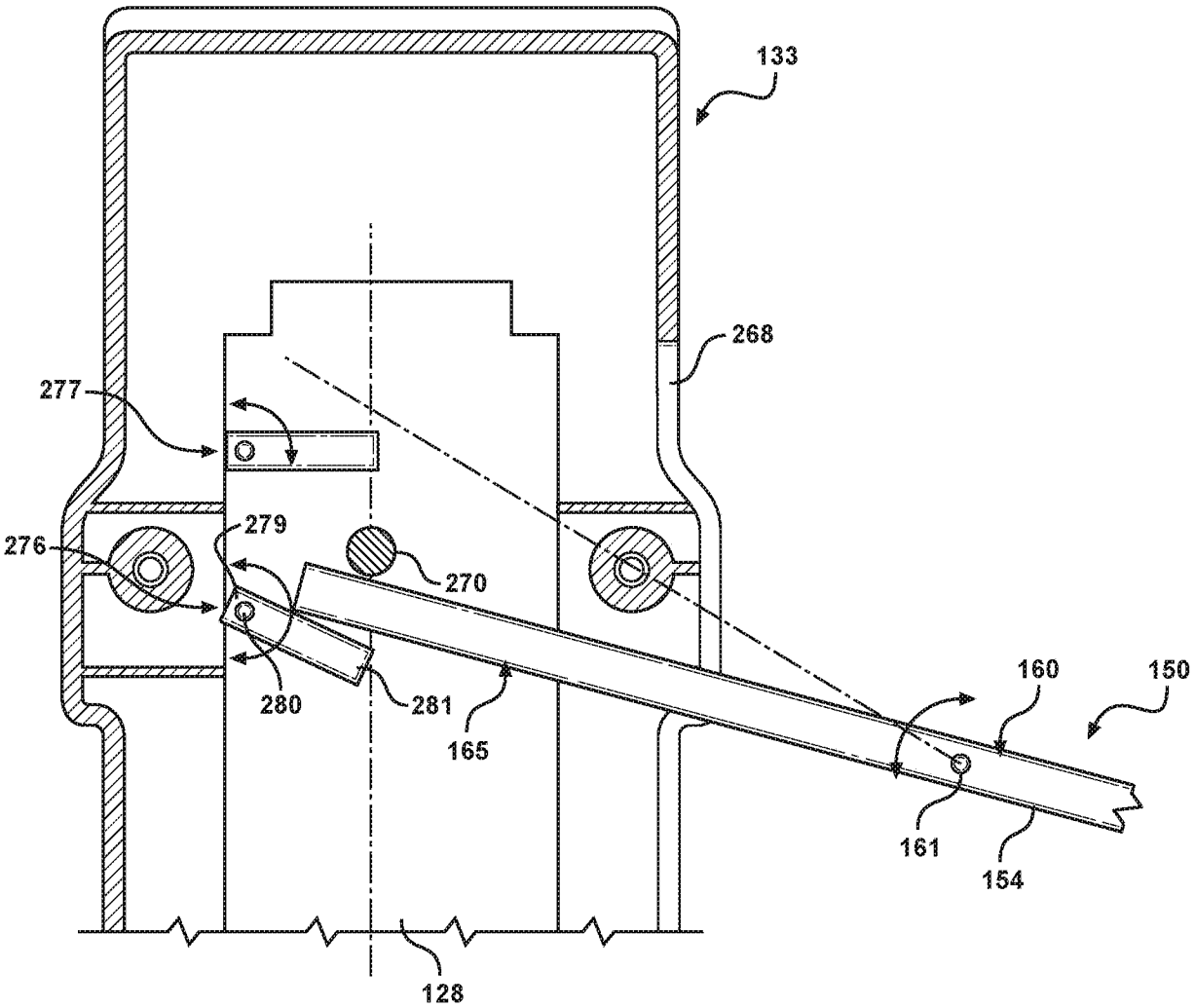
Figure 19:
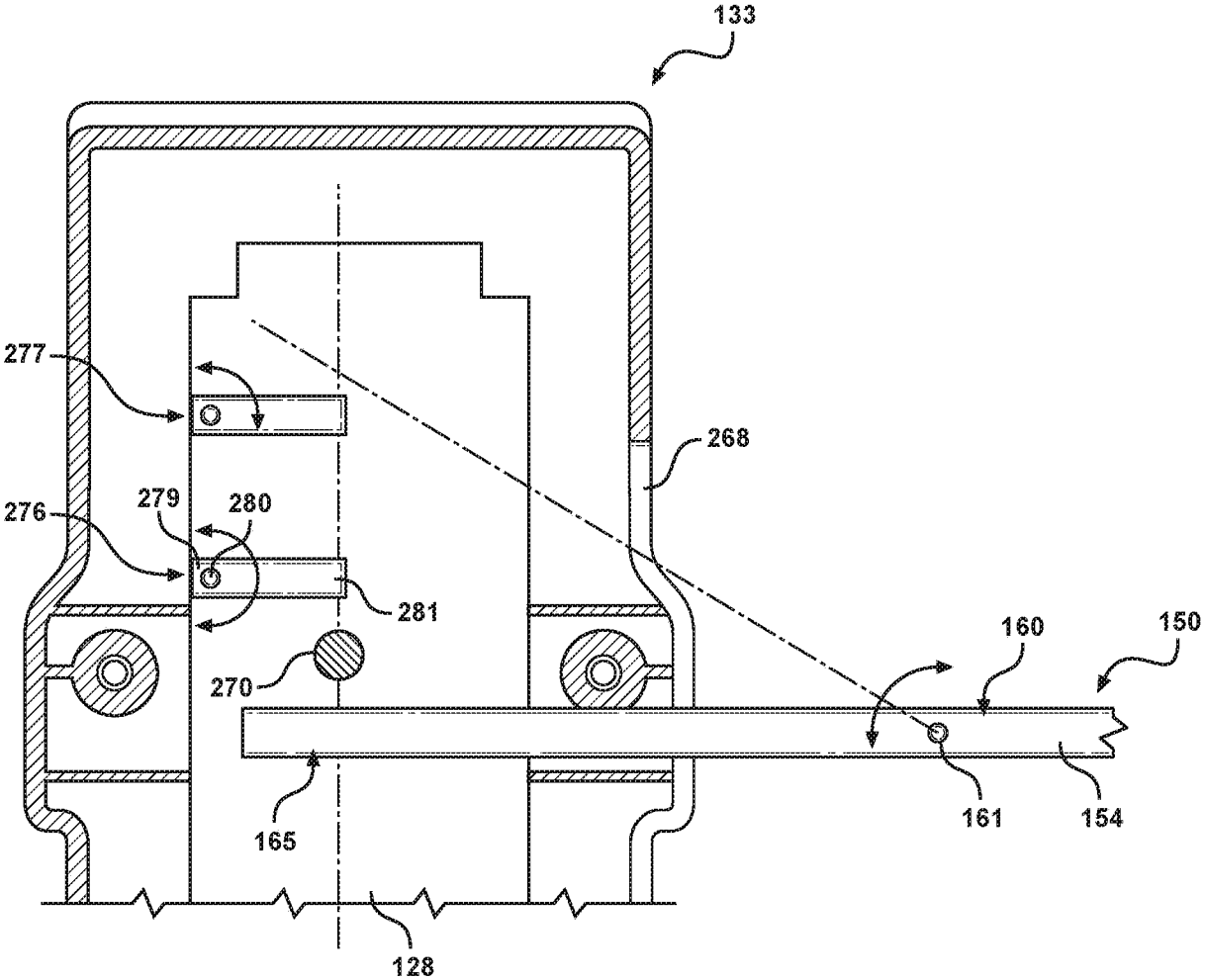

When it is desired to lower rack 16, control arm 150 is again shifted to raise terminal ends 165, with terminal end 165 abutting and directly pivoting first latch arm 276 as shown in FIG. 15. This pivoting of first latch arm 276 will cause simultaneous pivoting of second latch arm 277 as represented in this figure. Once second latch arm 277 clears retainer element 270, retainer element 270 will drop down upon terminal end 165 as shown in FIG. 16. Thereafter, control arm 150 is manipulated to lower terminal end 165 until reaching first latch arm 276 as shown in FIG. 17. Again, first latch arm 276 can pivot through 180 degrees such that control arm 150 can abut first latch arm 276 and continue to move past the same as shown in FIGS. 18 and 19 respectively. At this point, rack 16 is fully lowered as evident by comparing FIGS. 11 and 19.

Reference will now be made to FIGS. 20-26 in describing a still further latching mechanism embodiment wherein like reference numerals refer to corresponding parts to that described above. With initial reference to FIGS. 20 and 21, according to this embodiment, the latching mechanism includes a retainer element 330 in the form of a shiftable plate. Retainer element 330 includes an upper section 333 provided with an opening 335 that is depicted as being generally bowtie-shaped so as to define a fulcrum 336. Retainer element 330 also includes an intermediate section 337 having a cut-out 338 into which projects a flange 339 having a terminal bent portion 341. Finally, retainer element 330 includes a tapered section 343 leading to an in-turned terminal end portion 345. A mounting plate 350 is provided with a pair of spaced apertures 352 and 353 for securing mounting plate 350 to respective posts, one of which is indicated at 356 in FIG. 21, of shiftable support body 133 through the use of mechanical fasteners (not shown). Mounting plate 350 is provided with a central support member 359 that generally takes the form of a hook. As shown, central support member 359 projects through upper opening 335 of retainer element 330 such that retainer element 330 can pivot relative to mounting plate 350 along fulcrum 336. In addition, as will be detailed more fully below, retainer element 330 can shift upon support member 359 orthogonal to an axis of pivoting, i.e., in and out of the pages of these figures. To control the movement of retainer element 330, the latching mechanism also includes a spring 363 (see FIG. 21) which extends between a wall portion 365 of support body 133 and terminal bent portion 341 of flange 339. In general, spring 363 continually biases retainer element 330 to rotate in a clockwise direction while pushing retainer element 330 toward wall portion 365 as will become more fully evident below.

At this point, it should be recognized that shiftable support body 133 in accordance with this embodiment is generally constructed identical to that described above, with the inclusion of various ribs 180-186 and screw posts 189 and 190, and is mounted about upright body portion 128 for relative vertical sliding movement. With the perspective view of FIG. 21, additional details of support body 133 are illustrated. In particular, it will be noted that support body 133 is provided with various spaced lip defining members 396 and 397, as well as tab members 399, which are adapted to extend about edge portions (not separately labeled) on opposing sides of upright body portion 128 in order to slidably guide support body 133. In addition, this figure illustrates three upright side rails 434-436 of upper dish rack 16, as well as a portion of a cross rail 439 that interconnects upright rails 434-436. More specifically, upright rails 434 and 435 are sandwiched between outer body 135 and inner body member 136 of support body 133, while cross rail 439 extends entirely through support body 133 due to the presence of side openings 443 and 444. At this point, it should be understood that support body 133 could be attached to upper dish rack 16 in various ways and it is only important to note that upper dish rack 16 and support body 133 are vertically shiftable in unison in accordance with all of the disclosed embodiments. In accordance with this embodiment, it is the particular latching arrangement which is important to the present invention, as will now be described in detail.

Either attached to or formed as part of upright body portion 128 is a camming unit 451. Like upright body portion 128, camming unit 451 is vertically fixed such that it does not move vertically with upper dish rack 16 and support body 133, but can still shift into and out of washing chamber 14 with upper dish rack 16. As perhaps best shown in FIG. 21, camming unit 451 includes a first base portion 454 and a second base portion 455 which are offset by a first abutment wall 457. First abutment wall 457 establishes a first camming surface 458 including a flared portion 460. At the uppermost region of flared portion 460, camming unit 451 is provided with a first ramp 463 defined by a tapered side wall 464 and a ramp surface 465. Adjacent first ramp 463 is a first platform 466. Interposed between ramp surface 465 and first platform 466 is a second abutment wall 468. Projecting from first platform 466 is a ledge or plateau 470. With this arrangement, first ramp 463 leads from first base portion 454 to ledge 470. Provided along ledge 470 is a second ramp 474, including a tapered side wall 477 and a ramp surface 478. Second ramp 474 leads from first platform 466 to a second platform 481. Provided along second platform 481 and up adjacent second ramp 474 is a third abutment wall 485. Third abutment wall 485 includes a substantially linear portion 487 leading to an angled portion that defines a second camming surface 489. Spaced from each of first platform 466 and second platform 481 is a third platform 492 which leads through an angled portion 495 to second base portion 455. Therefore, in accordance with this embodiment of the invention, a multi-tier arrangement is established, including a first tier defined by base portion 454, a second tier defined by first platform 466 and a third tier defined by second platform 481. In addition, first ramp 463 interconnects the first and second tiers, while second ramp 474 interconnects the second and third tiers. With this arrangement, a guided path is established for terminal end portion 345 of retainer element 330 during movement of upper dish rack 16 between raised and lowered positions as will now be described in detail.

Figure 20:
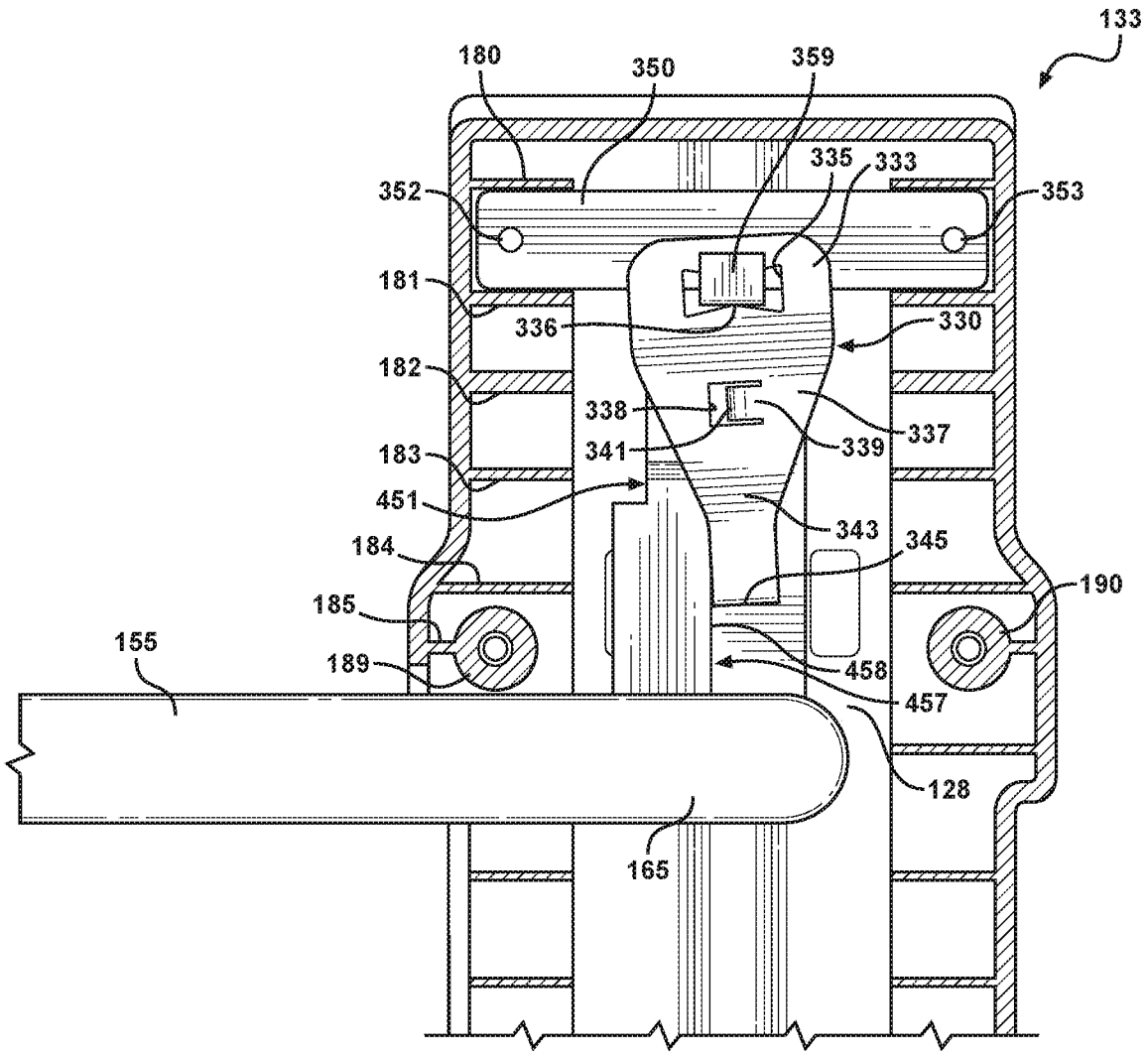
FIG. 20 is a cross-sectional view of a height adjustment mechanism with a latching mechanism constructed in accordance with a third embodiment of the invention.
Figure 21:
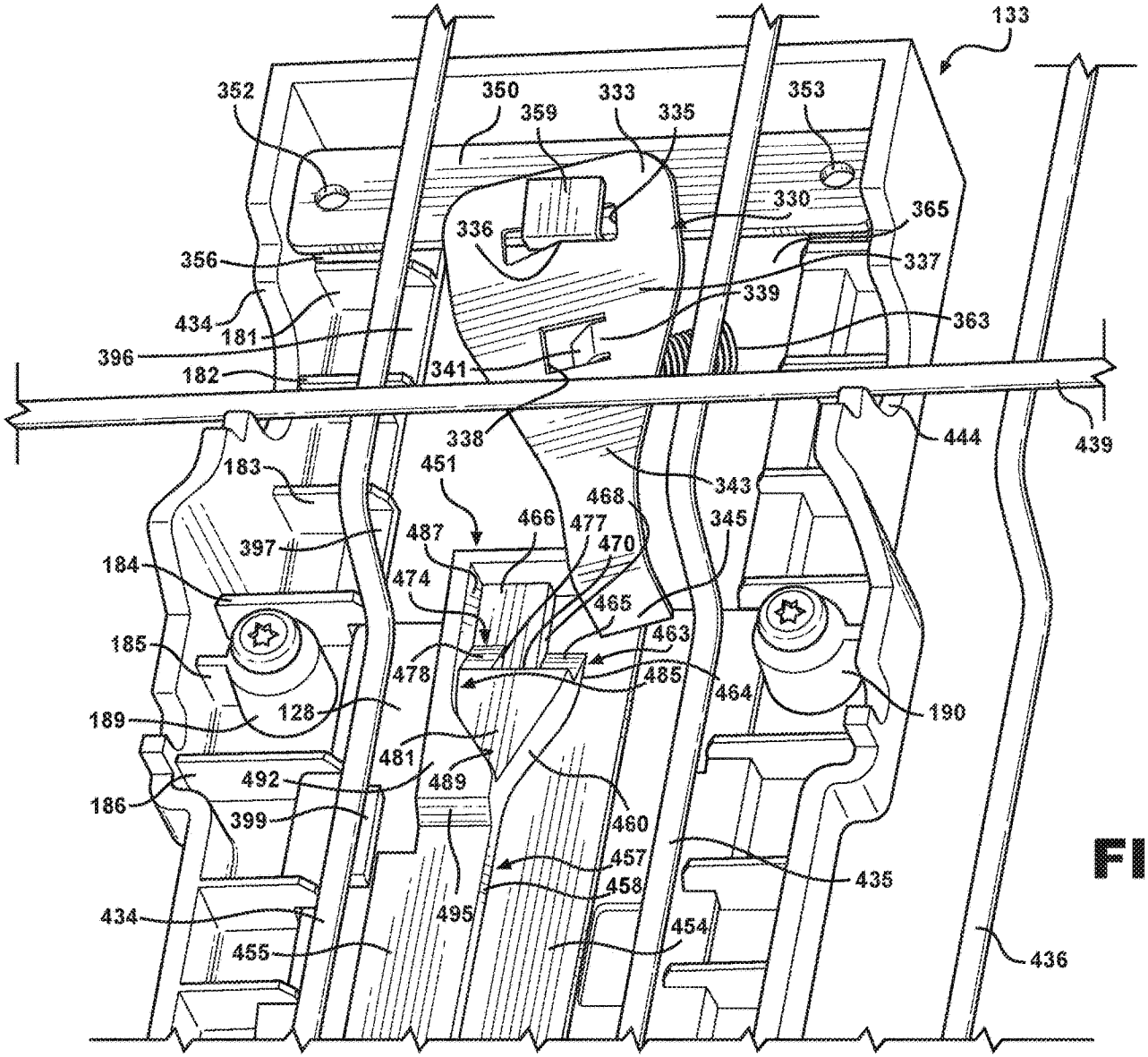
FIG. 21 is a perspective view of the height and latching mechanisms of FIG. 20.
Figure 22:
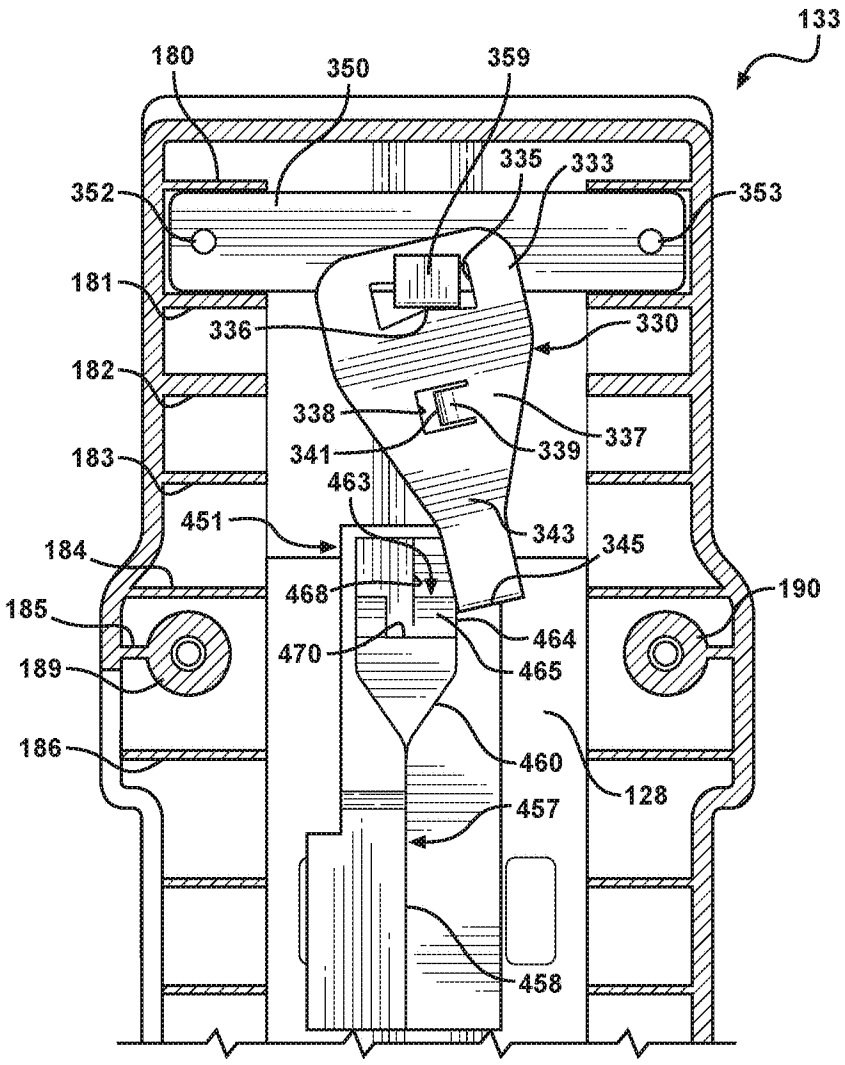
FIGS. 22-26 set forth additional views of the height and latching mechanisms of the third embodiment of the invention, shown through various vertically varying operational positions.
Figure 23:
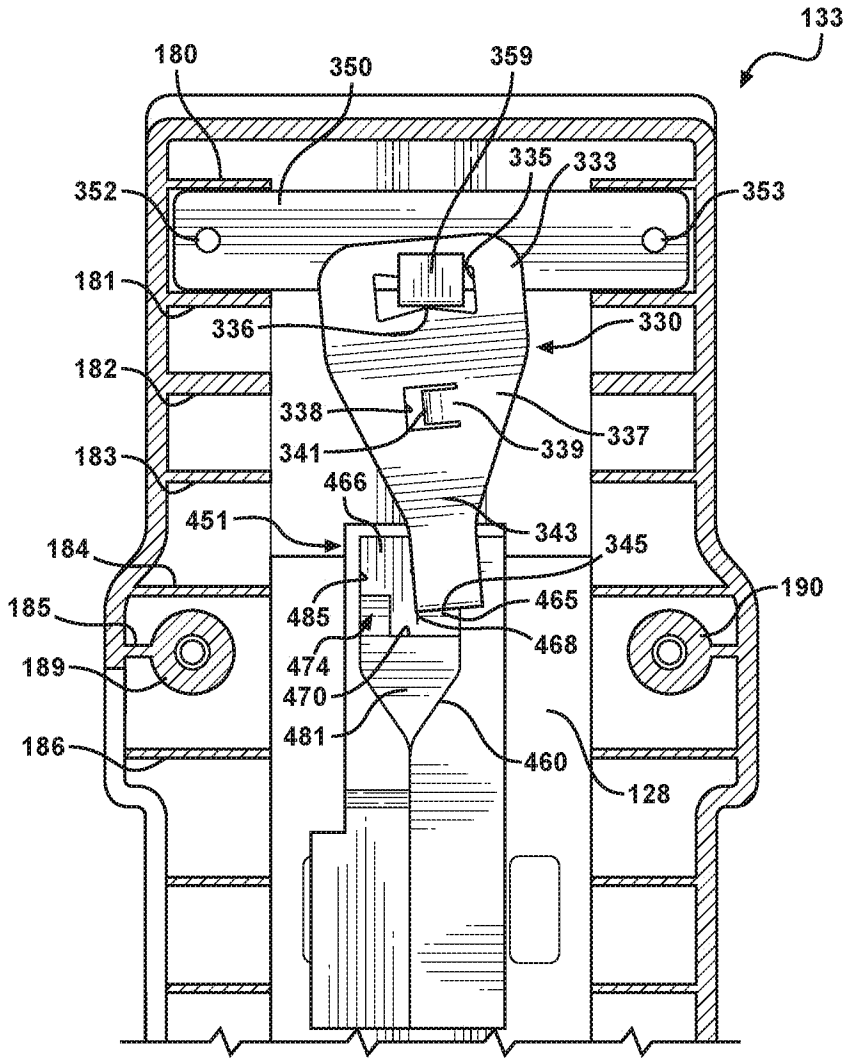
Figure 24:
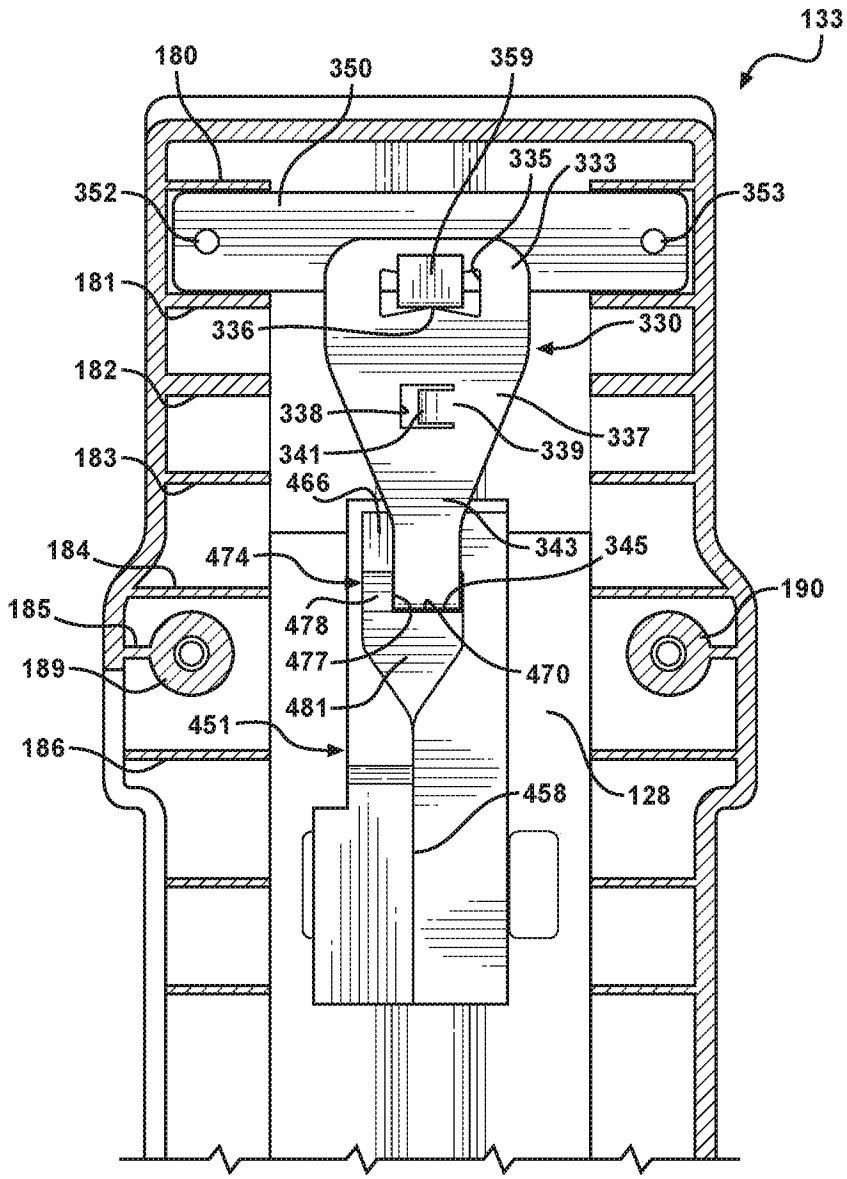

FIG. 20 shows that relative positioning between the various components of this embodiment when upper dish rack 16 is in its lowermost position. More specifically, retainer element 330 is biased by spring 363 such that terminal end portion 345 of tapered section 343 is in engagement with first abutment wall 457. As upper dish rack 16 and support body 133 are raised by terminal section 165 of a respective side lever 154, 155, terminal end portion 345, which defines a follower, rides along first camming surface 458, including flared portion 460, until terminal end portion 345 is positioned against tapered side wall 464 of first ramp 463 as shown in FIG. 22. At this point, spring 363 is biasing retainer element 330 to rotate clockwise, but retainer element 330 is prevented from doing so based on its abutment with tapered side wall 464. However, upon slight further raising of support body 133, terminal end portion 345 will shift to a position against second abutment wall 468 of first platform 466 as represented in FIG. 23. As side arm 155 is released, upper dish rack 16 will lower, causing terminal end portion 345 to ride along ramp surface 465 of first ramp 463 and become disengaged from second abutment wall 468 in order to assume the position shown in FIG. 24. In this position, terminal end portion 345 rests upon ledge 470 and is prevented from further rotation due to abutment with tapered side wall 477 of second ramp 474. Therefore, FIG. 24 depicts the position of upper dish rack 16 in its fully supported, raised position. In a manner described above, side arm 155 is biased to the lower position shown in this figure and remains there until needed to again reposition upper dish rack 16.

Figure 25:
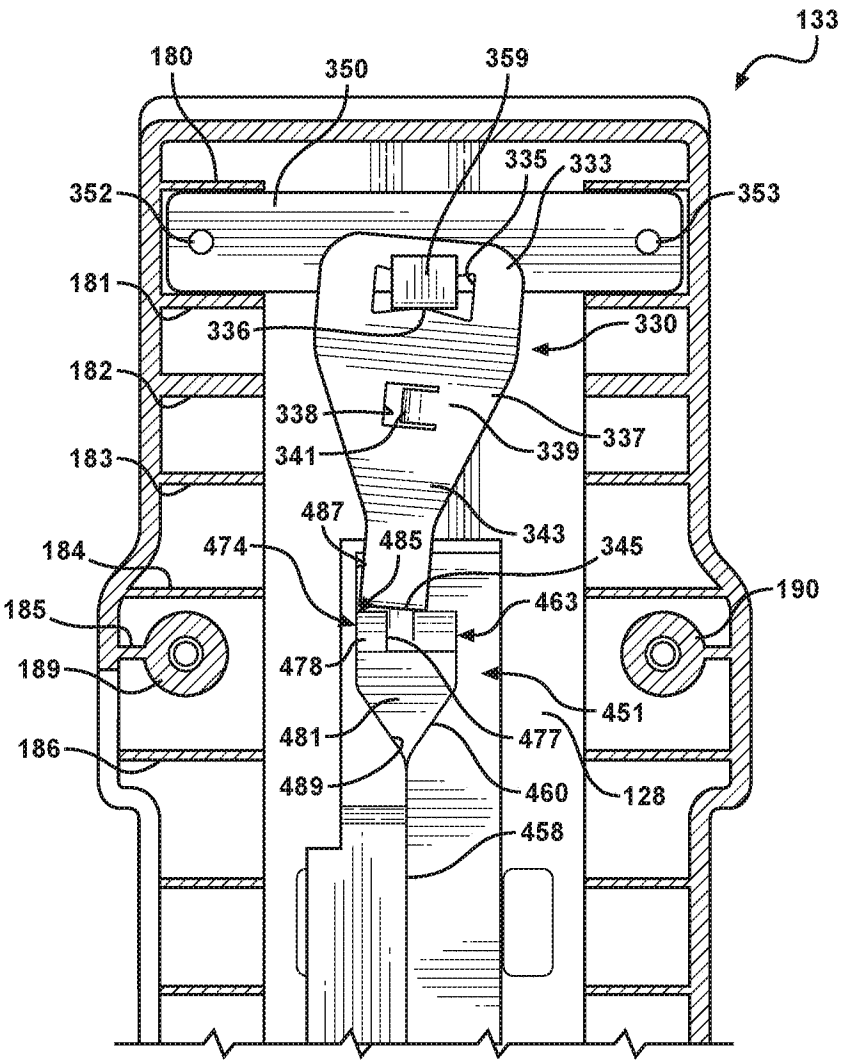
Figure 26:
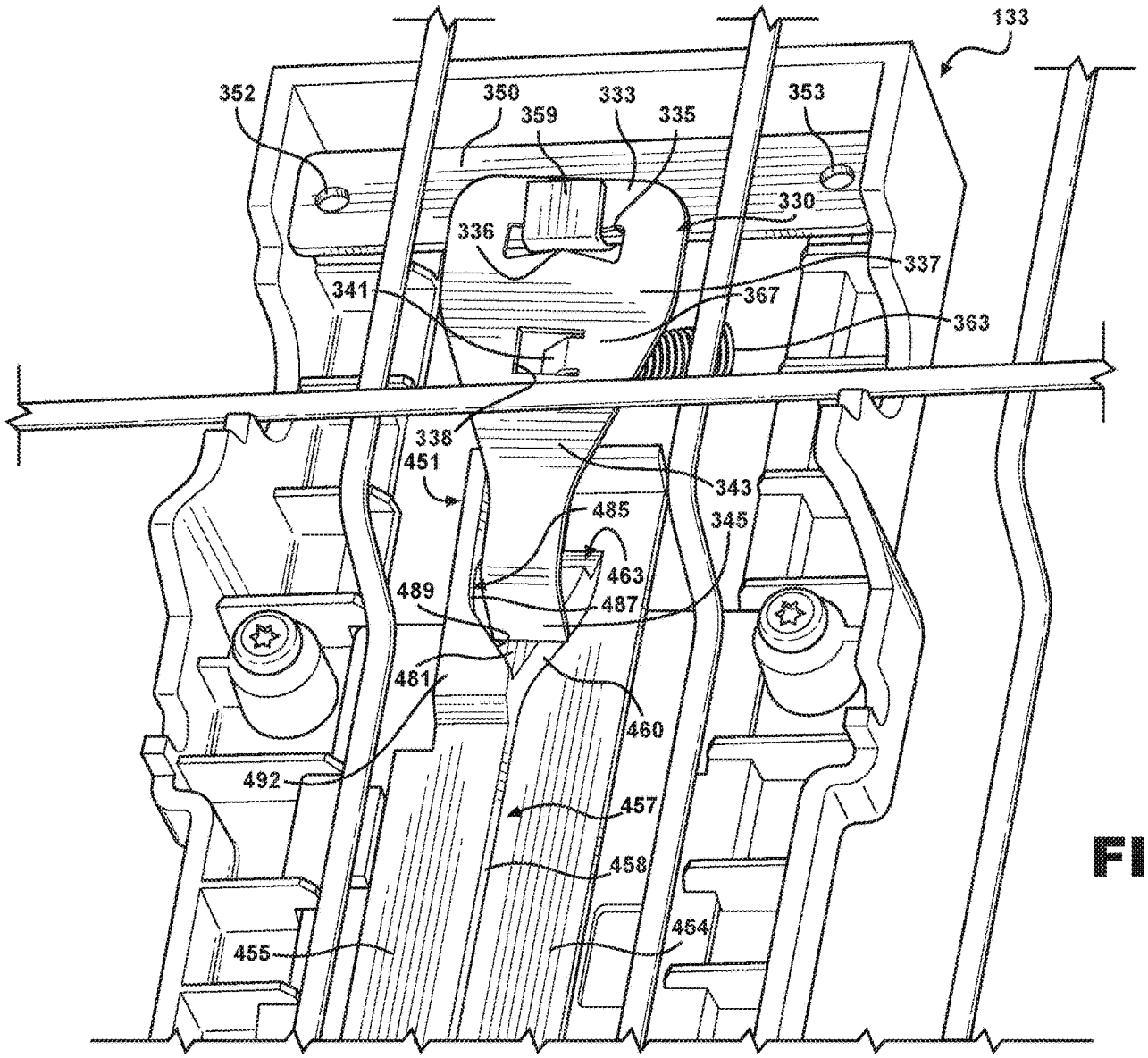

From the position shown in FIG. 24, upper dish rack 16 can be lowered, with side arm 155 being initially raised as shown in FIG. 25 to vertically shift terminal end portion 345 out of engagement with tapered side wall 477, thereby causing terminal end portion 345 to initially assume a position engaging substantially linear portion 487 of third abutment wall 485 then, upon lowering of upper dish rack 16, terminal end portion 345 will be caused to ride along ramp surface 478 of second ramp 474, while being in engagement with third abutment wall 485 as shown in FIG. 26. Continued lowering of upper dish rack 16 will cause terminal end portion 345 to transition from substantially linear portion 487 of third abutment wall 385 to second camming surface 489. Once terminal end portion 345 reaches the end of second camming surface 489, retainer element 330 will be caused to shift due to the biasing force of spring 363 such that terminal end portion 345 will again be in contact with first base portion 454 and first camming surface 458. At this point, upper dish rack 16 can readily assume the lowered position shown in FIG. 20.

Figure 27:
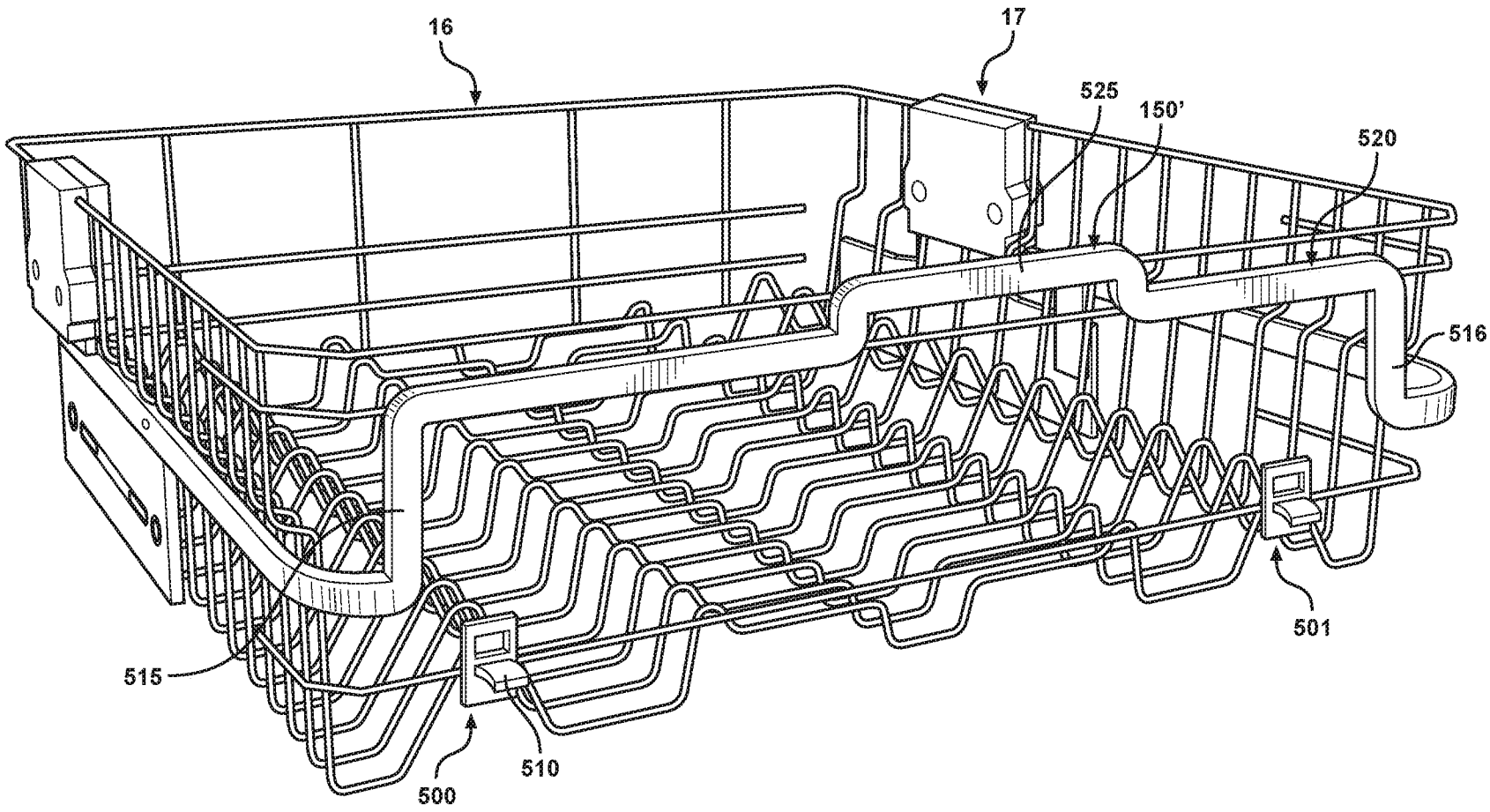
FIGS. 27 and 28 are perspective views, similar to that of FIG. 2, illustrating a potential variation of the control arm arrangement for the height adjustment mechanism, as well as a control arm associated latching mechanism.
Figure 28:
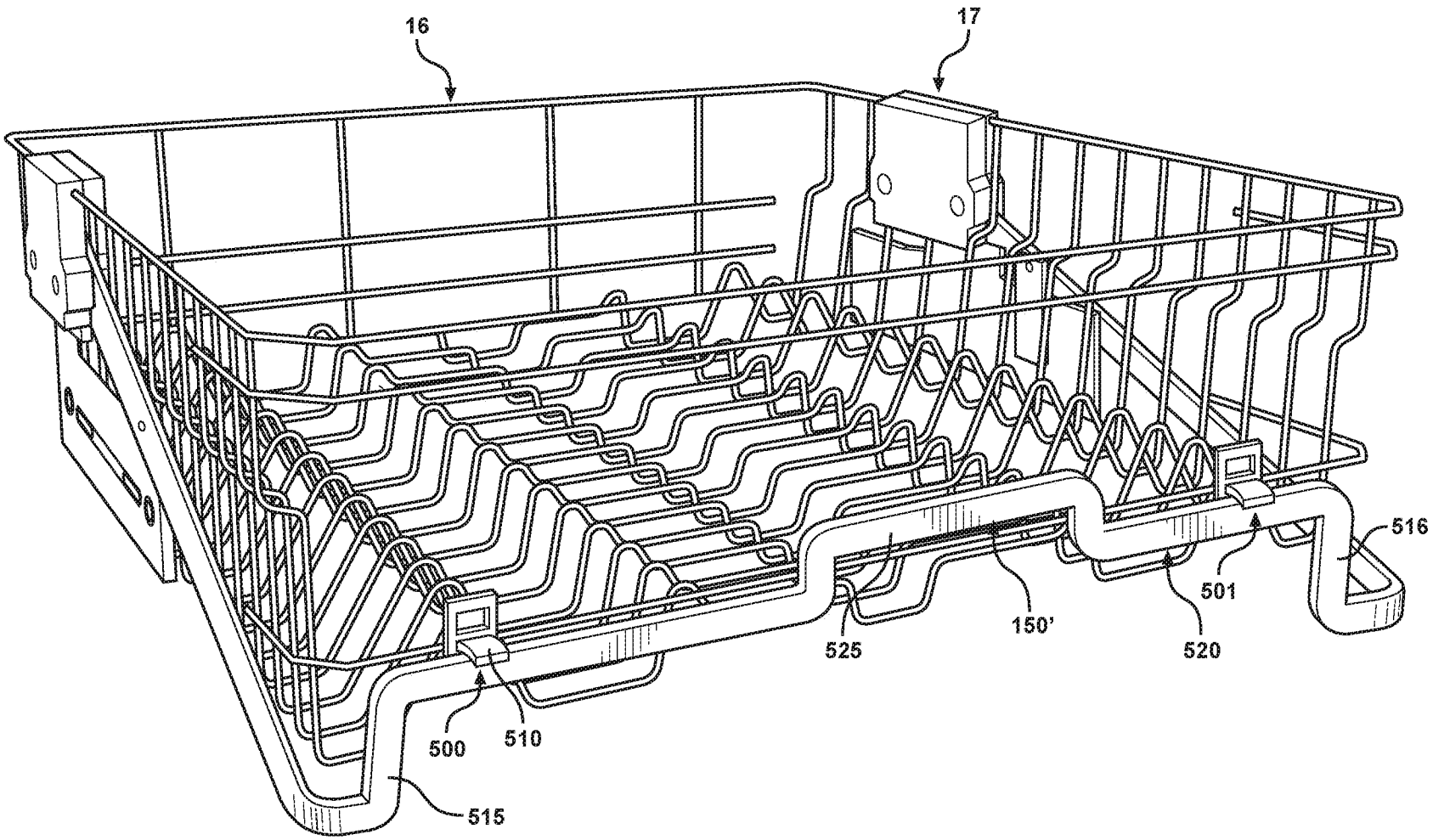

Instead of incorporating the latching mechanism within the support bodies 133, it is possible to employ latches which hold the control arm, and thereby upper dish rack 16 indirectly, in the raised position. FIGS. 27 and 28 show one potential embodiment wherein spaced latch members 500 and 501 are fixedly mounted to dish rack 16, with each latch member 500, 501 including a retainer element 510 in the form of a flexible tab element. In this embodiment, the depicted control arm 150 is actually shown as a variant to control arm 150 by including elevating side legs 515 and 516 which are interconnected by a cross bar 520 to again assume the position shown in FIG. 27.

Figure 29:
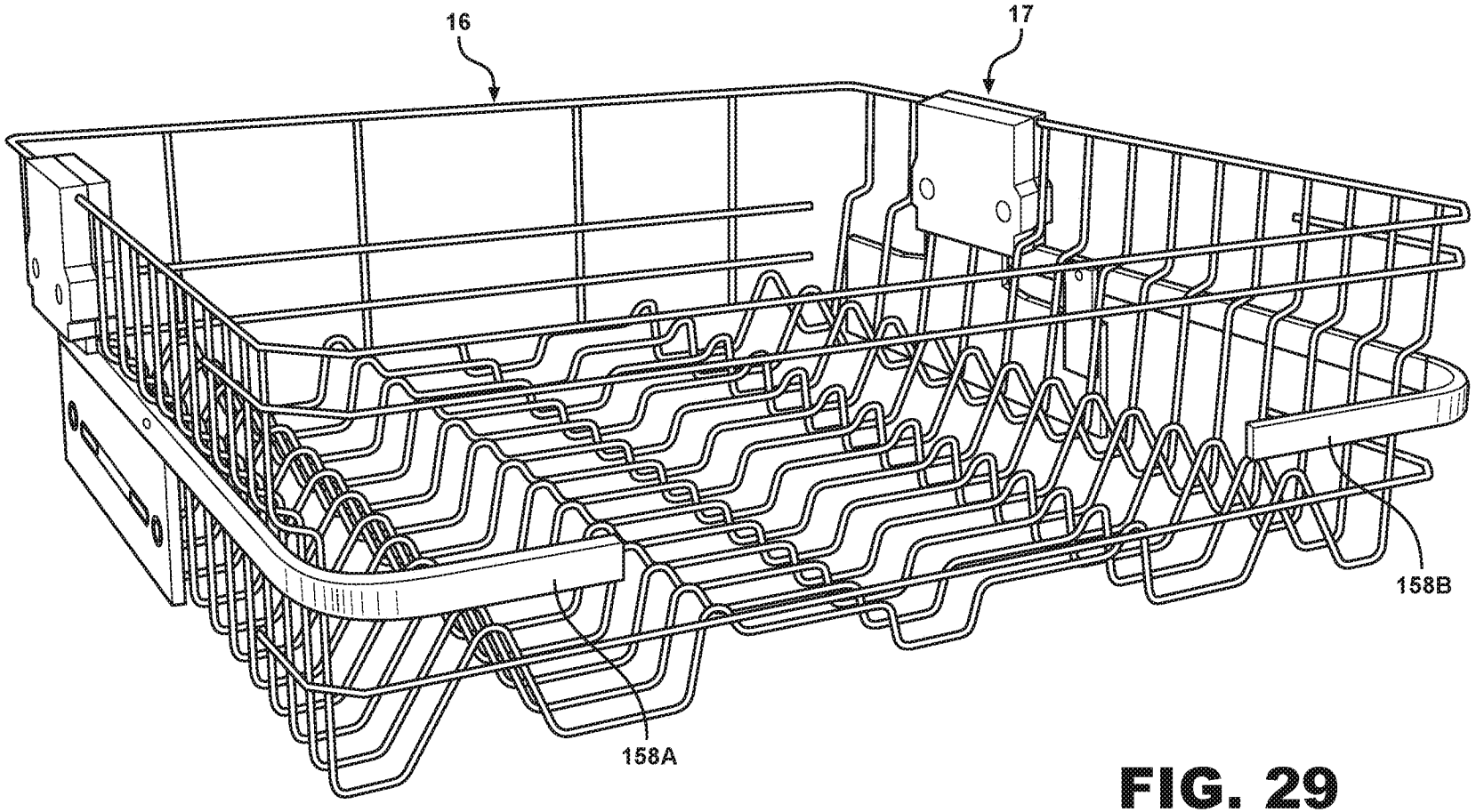
FIG. 29 is a perspective view, also similar to that of FIG. 2, illustrating an additional variation for the control arm arrangement for the height adjustment mechanism in accordance with the invention.
Figure 30:
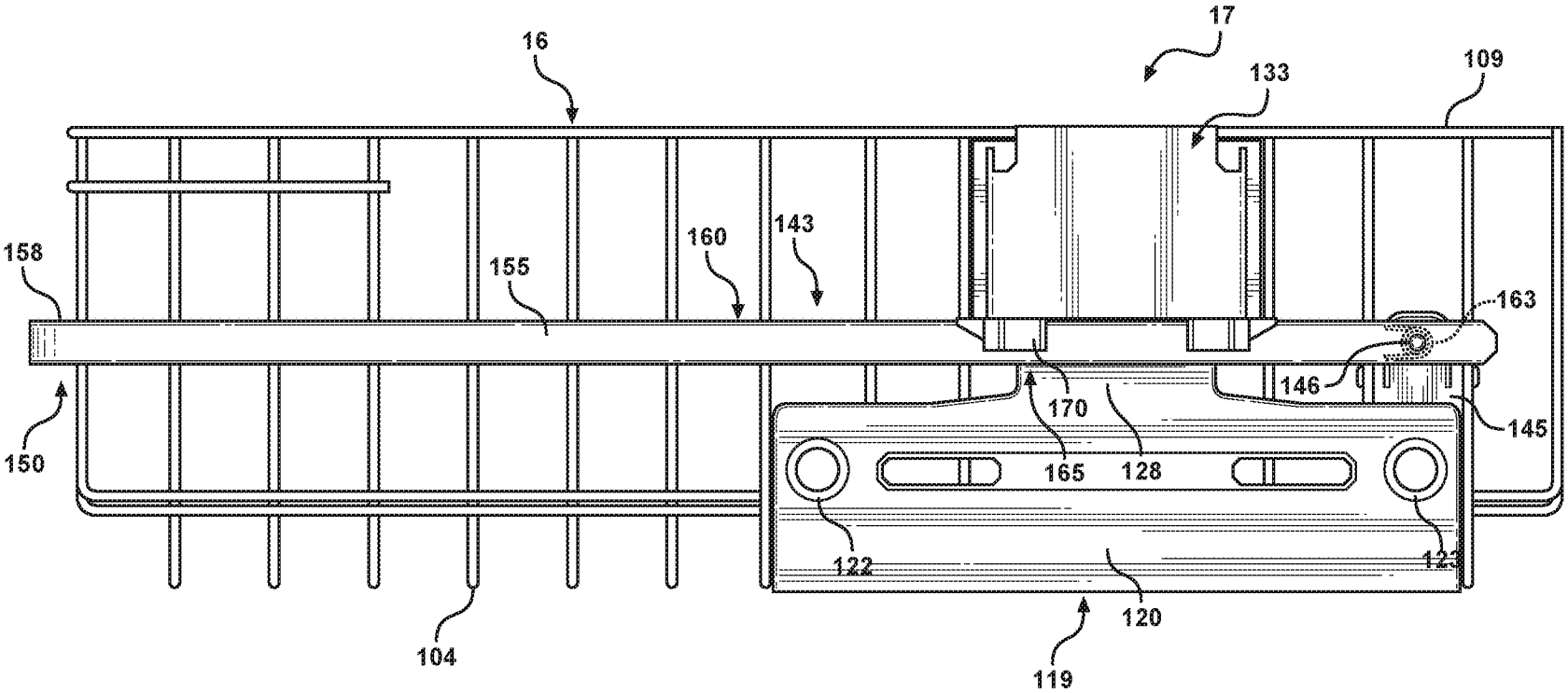
FIG. 30 is an elevational side view, similar to that of FIG. 3, of another embodiment of the rack with the height adjustment mechanism of the invention.

Based on the above, it should be readily apparent that the inclusion of a pivotal front cross bar in accordance with the invention provides a user easy access to the controls necessary to readily raise or lower the dish rack, regardless of the particular type of latching mechanism employed. Although described with respect to preferred embodiments of the invention, it should be readily understood that various changes or modifications can be made to the invention without departing from the spirit thereof. For instance, in each of the embodiments described above, the latching mechanisms were simultaneously operated by manually manipulating a unitary control arm, including side bars and a front cross bar. However, the control arm could also be formed from multiple pieces, such as side levers which are riveted or otherwise secured to a frontal cross bar, or separate control arm could be provided for each of the side latching mechanisms, with each control arm establishing a frontal cross bar segment that only extends partially across the front of the dish rack. This alternative arrangement is represented in FIG. 29 including frontal cross bar segments 158A and 158B each extending only partially across the front wall of the dish rack, being spaced from each other, and being directly connected to only a respective one of the first and second lever members. Basically, with this arrangement, the only difference is that a user would utilize both hands to manipulate the raising or lowering of the dish rack. Regardless of whether one, two or more components are utilized to establish the control arm with the frontal portion in accordance with the invention, it is also possible to shift the pivot points for the side levers. For example, each side lever could be extended and pivoted about its terminal section, with a corresponding repositioning of its related pivot support bracket, with the intermediate portion of the side lever directly lifting the shiftable support body and rack. This alternative arrangement is represented in FIG. 30 utilizing corresponding reference numerals to that described above, particularly with reference to FIG. 3.

Figure 31:
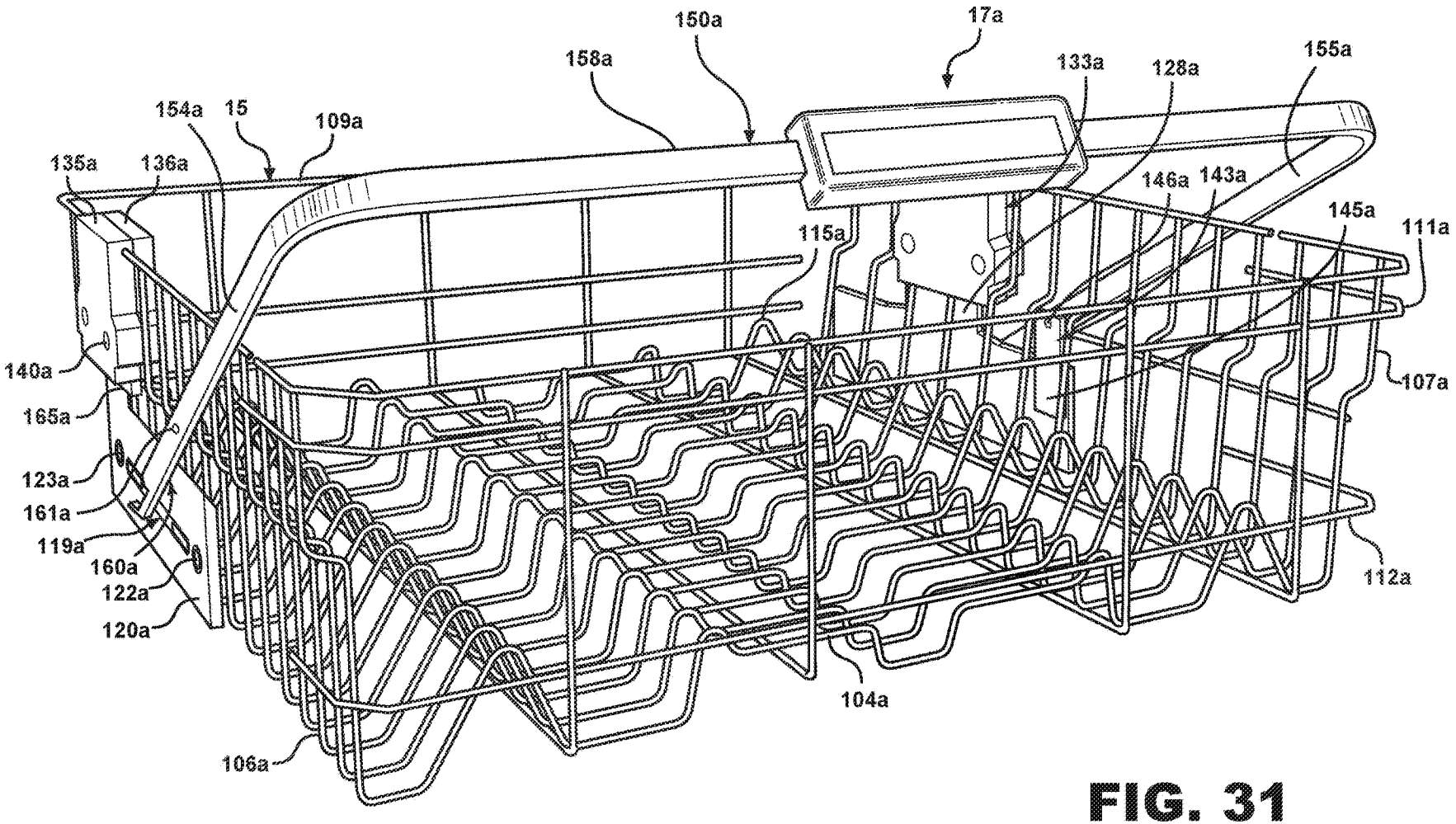
FIG. 31 is a perspective view, also similar to that of FIG. 2, illustrating an additional variation for the control arm arrangement for the height adjustment mechanism in accordance with the invention.
Figure 32:
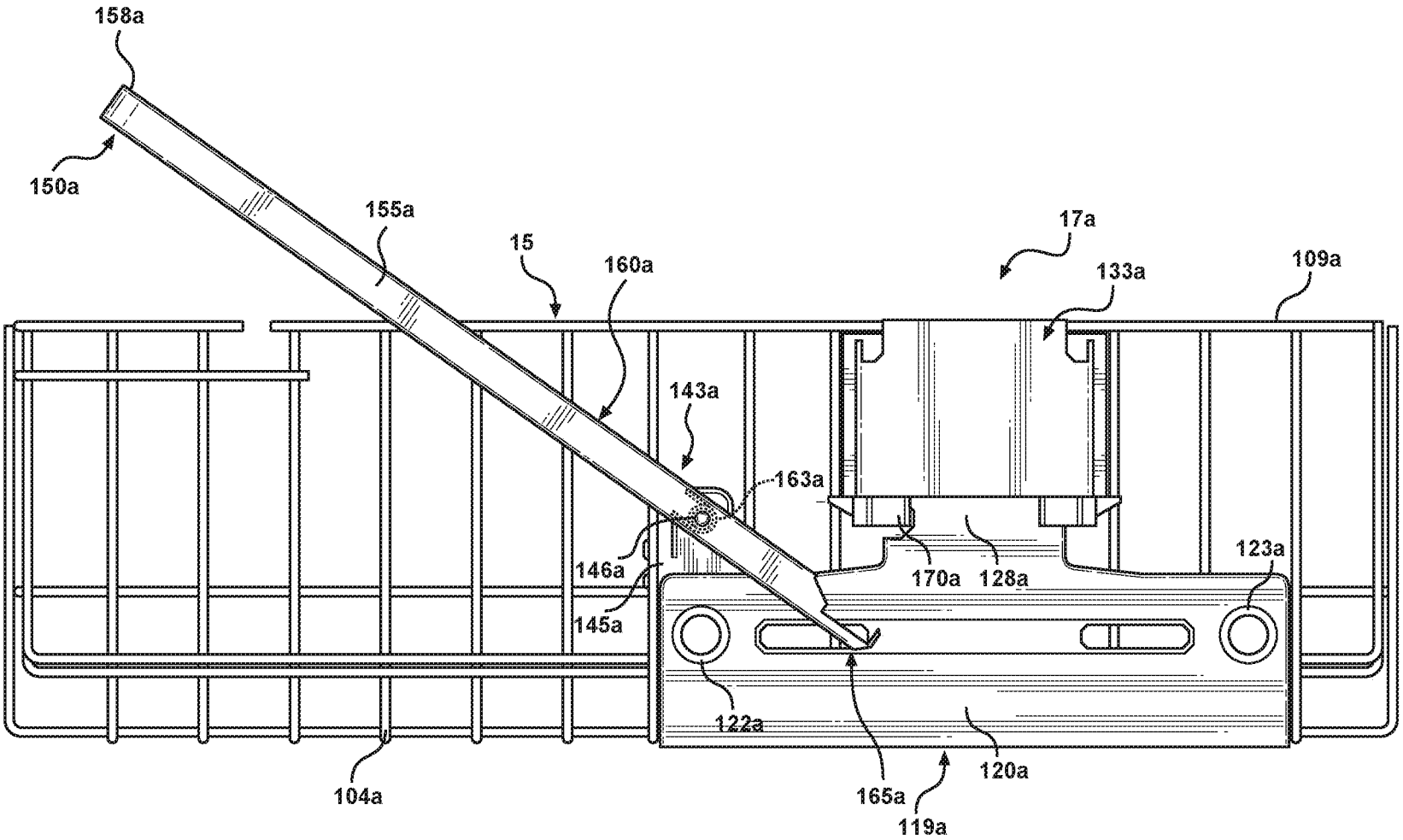
FIG. 32 is an elevational side view, similar to that of FIG. 3, of another embodiment of the rack with the height adjustment mechanism of the invention.

Reference will now be made to FIGS. 31 and 32 in describing the particular details of height adjustment mechanism 17*a* and its connection to rack 15. In the exemplary embodiment shown, rack 15 is formed of interconnected wires so as to define a plurality of bottom rails 104*a* which extend up and define opposing side rails 106*a*, 107*a*. Also shown is an upper peripheral rim rail 109*a* and a plurality of lower peripheral rails 111*a*, 112*a*. Bottom rails 104*a* have portions thereof which define multiple levels for rack 15 and are formed with various raised rail portions, such as that indicated at 115*a*, to more readily support various kitchenware items in a manner known in the art. In general, the particular construction and design of rack 15 can greatly vary in accordance with the invention and is known in the art. At this point, it is simply important to note that rack 15 includes bottom, side, rear and front walls (not separately labeled).

Height adjusting mechanism 17*a* of the invention is shown to include a base member 119*a* having a lower body portion 120 including mounts 122*a* and 123*a* for rotatably supporting a pair of fore-aft-spaced wheels (not shown) or rails (not shown) which interact with support members 26*a* carried by tub 5 in order to enable rack 15 to be shifted into and out of washing chamber 14 in a manner widely known in the art. Base member 119*a* also includes an upright or upper body portion 128*a* which is received within a shiftable support body 133*a*. More specifically, shiftable support body 133*a* includes an outer body 135*a* and an inner body member 136*a* which combine to clamp upon a respective set of side rails 106*a*, 107*a* and which are secured together by screws indicated at 140. At this point, it should be recognized that a separate base member 119*a* and shiftable support body 133*a* are provided on each of side rails 106*a*, 107*a* such that the overall height adjustment mechanism 17*a* can be readily understood from considering the structure and function of one side. In addition, height adjustment mechanism 17*a* includes a pair of pivot support brackets, one of which is indicated at 143*a*. Each of pivot support brackets 143*a* include a plate 145*a* that is either integrally formed with or rigidly secured to base member 119*a*, as well as a pivot pin 146*a* projecting from plate 145*a*. Finally, height adjustment mechanism 17*a* includes at least one control arm generally indicated at 150. In this embodiment, control arm 150*a* includes a pair of side levers 154*a* and 155*a* which are integrally formed with a frontal cross bar 158*a*. Each side lever 154*a*, 155*a* has an intermediate section 160*a* provided with an aperture 161*a* receiving a respective pivot pin 146*a*. With this arrangement, control arm 150*a* is generally U-shaped and pivotally mounted to base member 119*a* for movement about a pivot axis defined by aligned pins 146*a* by the manual manipulation of cross bar 158*a*. Cross bar 158*a* preferably extends above rack 15. A spring 163*a* (see FIG. 3) is preferably positioned between each intermediate section 160*a* and a respective pivot support bracket 143*a*. In this embodiment, spring 163*a* preferably constitute a torsion spring which biases frontal cross bar 158*a* in a downward or lowered condition. Each side lever 154*a*, 155*a* also includes a terminal section 165*a* which abuts shiftable support body 133*a* and preferably is laterally retained by a locating element 170*a* extending from shiftable support body 133*a*.

With this arrangement, it should be realized that the interengagement between each base member 119*a* with a respective support member 26*a* prevents base member 119*a* from shifting vertically relative to tub 5, while still enabling each base member 119*a* to move into and out of washing chamber 14. In addition, each pivot support bracket 143*a* is fixed to base member 119*a* and therefore also does not shift vertically. However, the clamping or sandwiching of side rails 106*a*, 107*a* by the shiftable support bodies 133*a* enables rack 15 and the shiftable support bodies 133*a* to move vertically relative to base member 119*a*. Since the upright body portion 128*a* of each base member 119*a* extends within a respective shiftable support body 133*a*, each support body 133*a* is guided for vertical movement relative to its base member 119*a*. With the pivotal mounting of control arm 150*a* and the engagement of each terminal section 165*a* with a respective shiftable support body 133*a*, the lowering of frontal cross bar 158*a* will cause terminal section 165*a* to be raised, hence raising both shiftable support bodies 133*a* and rack 15 relative to base members 119*a* and tub 5. In accordance with the invention, it is considered particularly advantageous that cross bar 158*a* extends along and above the front wall of rack 15 (entirely across the front wall in this embodiment) such that it is readily accessible from the front of dishwasher 2 as will become more fully evident below. It should also be recognized that, with the inclusion of springs 163*a*, control arm 150*a* is biased into the raised configuration shown in these figures such that, after being manipulated by a user to adjust the height of rack 15, control arm 150*a* will be automatically repositioned.

In accordance with the present invention, the particular number of vertical positions which can be established by rack 15 can vary greatly. In its simplest form, the invention contemplates just upper and lower positions, with the lower position being represented in FIGS. 31 and 32 wherein each shiftable support body 133 is bottomed out on a corresponding upper body portion 128*a* of base member 119*a* as detailed more fully below. More importantly, it is necessary to incorporate a form of latching to maintain rack 15 in any desired raised position. Although various different latching mechanisms or assemblies could be employed, FIGS. 4-10 describe one preferred mechanism.

As illustrated in these embodiments, a cross-section of shiftable support body 133 is depicted with upright body portion 128 extending therein. Internally, shiftable support body 133, which is preferably molded of plastic, is provided with a series of vertically spaced, internal ribs 180-186. Interconnected with rib 185 are screw posts 189 and 190 through which screws 140 extend. Rib 181 is formed with an extension 193 as discussed further below. Upright body portion 128 has lateral edges 196 and 197 closely spaced from internal ribs 182-186 and an in-turned end portion 199. In-turned end portion 199 is formed with fore-to-aft spaced notched regions 204 and 205 which define ledges 208 and 209 respectively. When rack 15 is in its lowered position, extension 193 of internal rib 181 sets upon ledges 208 and 209.

Mounted to in-turned end portion 199 is a latch housing 215. More specifically, latch housing 215 is secured to in-turned end portion 199 by means of a screw 217. Latch housing 215 includes a lower housing portion 219 from which projects a pivot pin 221 which rotatably supports a latch element 224. Latch element 224 includes first and second end portions (not separately labeled), each of which is formed with a groove 228, 229. Latch housing 215 also includes an upper housing portion 233 that carries a spring 235 within a bore 238. Spring 235 acts upon a ball 241 in order to bias ball 241 against latch element 224. Certainly, ball 241 will have a tendency to become seated in one of grooves 228 and 229 to retain latch element 224 in selected positions such that this overall ball and groove structure establishes a detent arrangement. At this point, it should be realized that these figures also set forth a cross-section of latch housing 215 such that latch element 224 is preferably internally disposed, while latch housing 215 includes a side slot indicated at 244 through which a portion of latch element 224 can project. The latching mechanism of the invention also includes retainer element 253 which is formed integral with shiftable support body 133 so as to be vertically shiftable in unison with rack 15. In the embodiment depicted, retainer element 253 is shown to include an annular body 256 having a central opening 258 sized to receive latch housing 215.

As stated above, FIG. 3 represents rack 15 in its lowered position wherein retainer element 253 is spaced vertically below latch housing 215. Upon the grasping and lowering of frontal cross bar 158, control arm 150 will pivot about pins 146 such that shiftable support bodies 133 and rack 16 will be lifted vertically upward as represented in FIG. 5 wherein latch housing 215 has been received within central opening 258 of annular body 256 and retainer element 253 has caused latch element 224 to rotate counterclockwise about pivot pin 221, while ball 241 has ridden upon groove 228 against the biasing force of spring 235. Once retainer element 253 clears latch element 224 as shown in FIG. 6, latch element 224 will rotate clockwise with ball 241 again being received in groove 228. Thereafter, rack 15 will be lowered which causes retainer element 253 to again engage latch element 224 and rotate the same until the position shown in FIG. 7 is reached. In this position, latch element 224 reaches a binding point and rack 15 is maintained in a desired, raised position.

When it is desired to lower rack 15, control arm 150 is again engaged to slightly raise rack 15 from the position shown in FIG. 7 to that shown in FIG. 8 wherein retaining element 253 is located above latch element 224 and latch element 224 is caused to further rotate clockwise due to the engagement with ball 241 and the biasing of spring 235. Rack 15 can then be lowered. During the lowering process, retainer element 253 will initially engage latch element 224 and cause the same to rotate clockwise as depicted in FIG. 9. As rack 15 is further lowered, retainer element 253 will continue to rotate latch element 224 until ball 241 is received within groove 229 as shown in FIG. 10. At this point, retainer element 253 will clear latch housing 215 and rack 15 can readily assume the position shown in FIG. 4. At the same time, latch element 224 is again in the position shown in FIG. 4 such that rack 15 can again be selectively re-raised in the same manner described above.

As indicated above, frontal cross bar 158*a* can be used to raise rack 15 in accordance with the present invention with various different latching mechanisms. By way of another example, reference is made to FIGS. 11-19 which illustrate a second latching mechanism embodiment wherein like reference numerals refer to corresponding parts with that described above. In accordance with this embodiment, each shiftable support body 133 is formed with a side slot 268 through which extends terminal section 165 of a respective side lever 154, 155. Instead of retainer element 253 in the form of a ring, this embodiment employs a retainer element 270 in the form of a pin or rod. As with retainer element 253, retainer element 270 is fixed for movement with both shiftable support body 133 and rack 15. Also in accordance with this embodiment, mounted upon upper body portion 128 of base member 119 is a first latch element or arm 276 and a second latch element or arm 277. As shown labeled on latch arm 276, each latch arm 276, 277 includes a first end 279 which is pivotally mounted through a pin 280 to upper body portion 128, and a second end 281 remote from pin 280.

FIG. 11 shows the relative positioning between the various components of rack 15 in its lowermost position. When it is desired to raise rack 15, control arm 150 is again manually grasped and lowered from above rack 15 to cause the same to pivot about pins 146 such that terminal sections 165 are raised. Upon raising, each terminal section 165 engages a respective retainer element 270 and lifts the same. Initially, retainer element 270 will abut first latch arm 276 and cause the same to rotate upward as shown in FIG. 12. Although not depicted, first latch arm 276 and second latch arm 277 are interconnected such that rotation of first latch arm 276 will also cause second latch arm 277 to rotate as clearly shown in FIG. 12. This connection can take various mechanical forms, such as suitable gearing or belt drive arrangement. However, it is important to note that first latch arm 276 is permitted to rotate through 180 degrees represented by the arrows in this figure, while second latch arm 277 can only rotate through 90 degrees. In any case, continued raising of control arm 150 (which is shown broken off at terminal end 165 for clarity of the drawing) causes retainer element 270 to extend above second latch arm 277 as represented in FIG. 13. Thereafter, control arm 150 can be lowered and retainer element 270 will be supported upon first latch arm 276 as represented in FIG. 14.

When it is desired to lower rack 15, control arm 150 is again shifted to raise terminal ends 165, with terminal end 165 abutting and directly pivoting first latch arm 276 as shown in FIG. 15. This pivoting of first latch arm 276 will cause simultaneous pivoting of second latch arm 277 as represented in this figure. Once second latch arm 277 clears retainer element 270, retainer element 270 will drop down upon terminal end 165 as shown in FIG. 16. Thereafter, control arm 150 is manipulated to lower terminal end 165 until reaching first latch arm 276 as shown in FIG. 17. Again, first latch arm 276 can pivot through 180 degrees such that control arm 150 can abut first latch arm 276 and continue to move past the same as shown in FIGS. 18 and 19 respectively. At this point, rack 15 is fully lowered as evident by comparing FIGS. 11 and 19.

Reference will now be made to FIGS. 20-26 in describing a still further latching mechanism embodiment wherein like reference numerals refer to corresponding parts to that described above. With initial reference to FIGS. 20 and 21, according to this embodiment, the latching mechanism includes a retainer element 330 in the form of a shiftable plate. Retainer element 330 includes an upper section 333 provided with an opening 335 that is depicted as being generally bowtie-shaped so as to define a fulcrum 336. Retainer element 330 also includes an intermediate section 337 having a cut-out 338 into which projects a flange 339 having a terminal bent portion 341. Finally, retainer element 330 includes a tapered section 343 leading to an in-turned terminal end portion 345. A mounting plate 350 is provided with a pair of spaced apertures 352 and 353 for securing mounting plate 350 to respective posts, one of which is indicated at 356 in FIG. 21, of shiftable support body 133 through the use of mechanical fasteners (not shown). Mounting plate 350 is provided with a central support member 359 that generally takes the form of a hook. As shown, central support member 359 projects through upper opening 335 of retainer element 330 such that retainer element 330 can pivot relative to mounting plate 350 along fulcrum 336. In addition, as will be detailed more fully below, retainer element 330 can shift upon support member 359 orthogonal to an axis of pivoting, i.e., in and out of the pages of these figures. To control the movement of retainer element 330, the latching mechanism also includes a spring 363 (see FIG. 21) which extends between a wall portion 365 of support body 133 and terminal bent portion 341 of flange 339. In general, spring 363 continually biases retainer element 330 to rotate in a clockwise direction while pushing retainer element 330 toward wall portion 365 as will become more fully evident below.

At this point, it should be recognized that shiftable support body 133 in accordance with this embodiment is generally constructed identical to that described above, with the inclusion of various ribs 180-186 and screw posts 189 and 190, and is mounted about upright body portion 128 for relative vertical sliding movement. With the perspective view of FIG. 21, additional details of support body 133 are illustrated. In particular, it will be noted that support body 133 is provided with various spaced lip defining members 396 and 397, as well as tab members 399, which are adapted to extend about edge portions (not separately labeled) on opposing sides of upright body portion 128 in order to slidably guide support body 133. In addition, this figure illustrates three upright side rails 434-436 of lower dish rack 15, as well as a portion of a cross rail 439 that interconnects upright rails 434-436. More specifically, upright rails 434 and 435 are sandwiched between outer body 135 and inner body member 136 of support body 133, while cross rail 439 extends entirely through support body 133 due to the presence of side openings 443 and 444. At this point, it should be understood that support body 133 could be attached to lower dish rack 15 in various ways and it is only important to note that lower dish rack 15 and support body 133 are vertically shiftable in unison in accordance with all of the disclosed embodiments. In accordance with this embodiment, it is the particular latching arrangement which is important to the present invention, as will now be described in detail.

Either attached to or formed as part of upright body portion 128 is a camming unit 451. Like upright body portion 128, camming unit 451 is vertically fixed such that it does not move vertically with lower dish rack 15 and support body 133, but can still shift into and out of washing chamber 14 with lower dish rack 15. As perhaps best shown in FIG. 21, camming unit 451 includes a first base portion 454 and a second base portion 455 which are offset by a first abutment wall 457. First abutment wall 457 establishes a first camming surface 458 including a flared portion 460. At the uppermost region of flared portion 460, camming unit 451 is provided with a first ramp 463 defined by a tapered side wall 464 and a ramp surface 465. Adjacent first ramp 463 is a first platform 466. Interposed between ramp surface 465 and first platform 466 is a second abutment wall 468. Projecting from first platform 466 is a ledge or plateau 470. With this arrangement, first ramp 463 leads from first base portion 454 to ledge 470. Provided along ledge 470 is a second ramp 474, including a tapered side wall 477 and a ramp surface 478. Second ramp 474 leads from first platform 466 to a second platform 481. Provided along second platform 481 and up adjacent second ramp 474 is a third abutment wall 485. Third abutment wall 485 includes a substantially linear portion 487 leading to an angled portion that defines a second camming surface 489. Spaced from each of first platform 466 and second platform 481 is a third platform 492 which leads through an angled portion 495 to second base portion 455. Therefore, in accordance with this embodiment of the invention, a multi-tier arrangement is established, including a first tier defined by base portion 454, a second tier defined by first platform 466 and a third tier defined by second platform 481. In addition, first ramp 463 interconnects the first and second tiers, while second ramp 474 interconnects the second and third tiers. With this arrangement, a guided path is established for terminal end portion 345 of retainer element 330 during movement of lower dish rack 15 between raised and lowered positions as will now be described in detail.

FIG. 20 shows that relative positioning between the various components of this embodiment when lower dish rack 15 is in its lowermost position. More specifically, retainer element 330 is biased by spring 363 such that terminal end portion 345 of tapered section 343 is in engagement with first abutment wall 457. As lower dish rack 15 and support body 133 are raised by terminal section 165 of a respective side lever 154, 155, terminal end portion 345, which defines a follower, rides along first camming surface 458, including flared portion 460, until terminal end portion 345 is positioned against tapered side wall 464 of first ramp 463 as shown in FIG. 22. At this point, spring 363 is biasing retainer element 330 to rotate clockwise, but retainer element 330 is prevented from doing so based on its abutment with tapered side wall 464. However, upon slight further raising of support body 133, terminal end portion 345 will shift to a position against second abutment wall 468 of first platform 466 as represented in FIG. 23. As side arm 155 is released, lower dish rack 15 will lower, causing terminal end portion 345 to ride along ramp surface 465 of first ramp 463 and become disengaged from second abutment wall 468 in order to assume the position shown in FIG. 24. In this position, terminal end portion 345 rests upon ledge 470 and is prevented from further rotation due to abutment with tapered side wall 477 of second ramp 474. Therefore, FIG. 24 depicts the position of lower dish rack 15 in its fully supported, raised position. In a manner described above, side arm 155 is biased to the lower position shown in this figure and remains there until needed to again reposition lower dish rack 15.

From the position shown in FIG. 53, lower dish rack 15 can be lowered, with side arm 155 being initially raised as shown in FIG. 54 to vertically shift terminal end portion 345 out of engagement with tapered side wall 477, thereby causing terminal end portion 345 to initially assume a position engaging substantially linear portion 487 of third abutment wall 485 then, upon lowering of lower dish rack 15, terminal end portion 345 will be caused to ride along ramp surface 478 of second ramp 474, while being in engagement with third abutment wall 485 as shown in FIG. 55. Continued lowering of lower dish rack 15 will cause terminal end portion 345 to transition from substantially linear portion 487 of third abutment wall 485 to second camming surface 489. Once terminal end portion 345 reaches the end of second camming surface 489, retainer element 330 will be caused to shift due to the biasing force of spring 363 such that terminal end portion 345 will again be in contact with first base portion 454 and first camming surface 458. At this point, lower dish rack 15 can readily assume the lowered position shown in FIG. 20.

Figure 33:
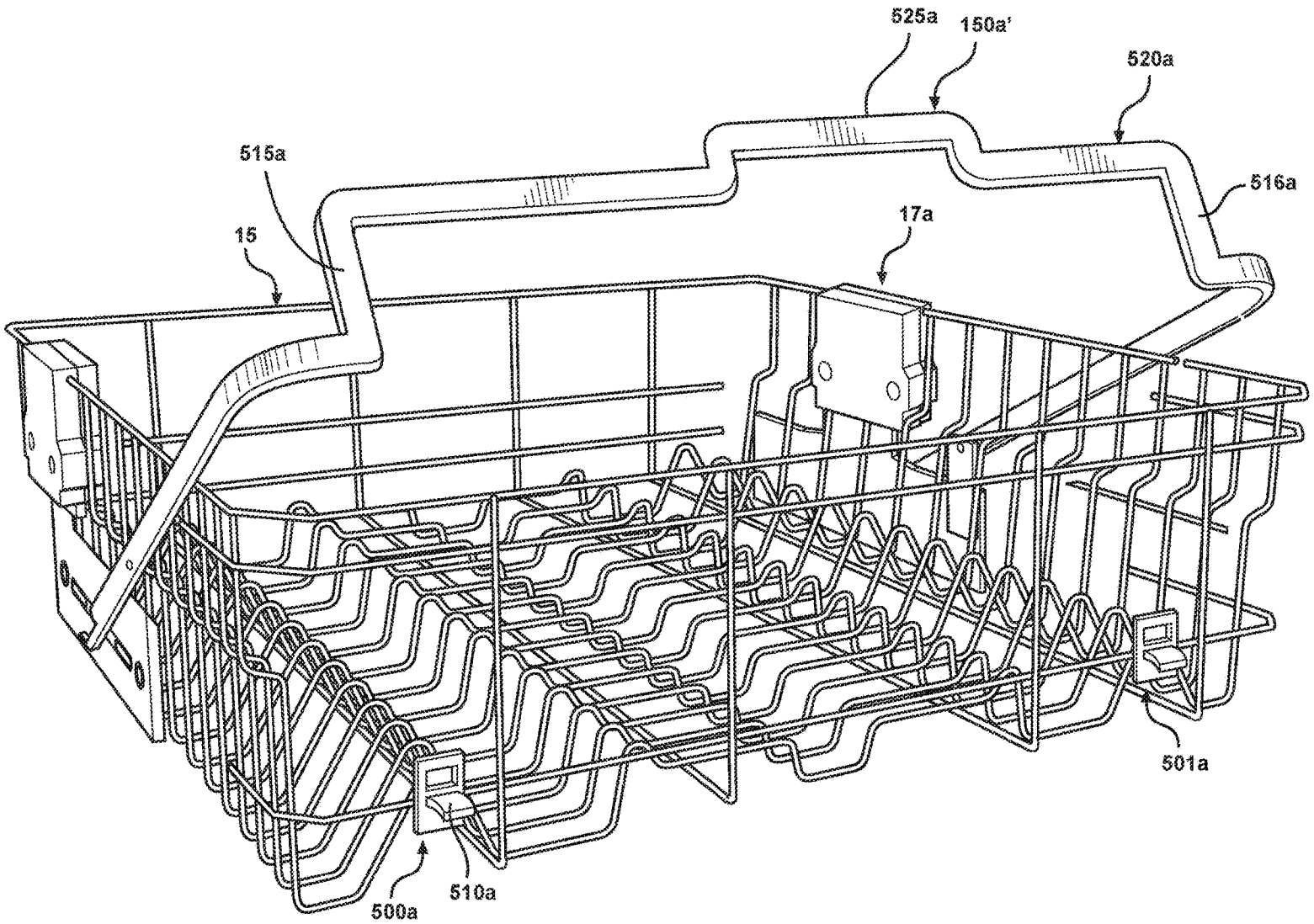
FIGS. 33 and 34 are perspective views, similar to that of FIG. 2, illustrating a potential variation of the control arm arrangement for the height adjustment mechanism, as well as a control arm associated latching mechanism.
Figure 34:
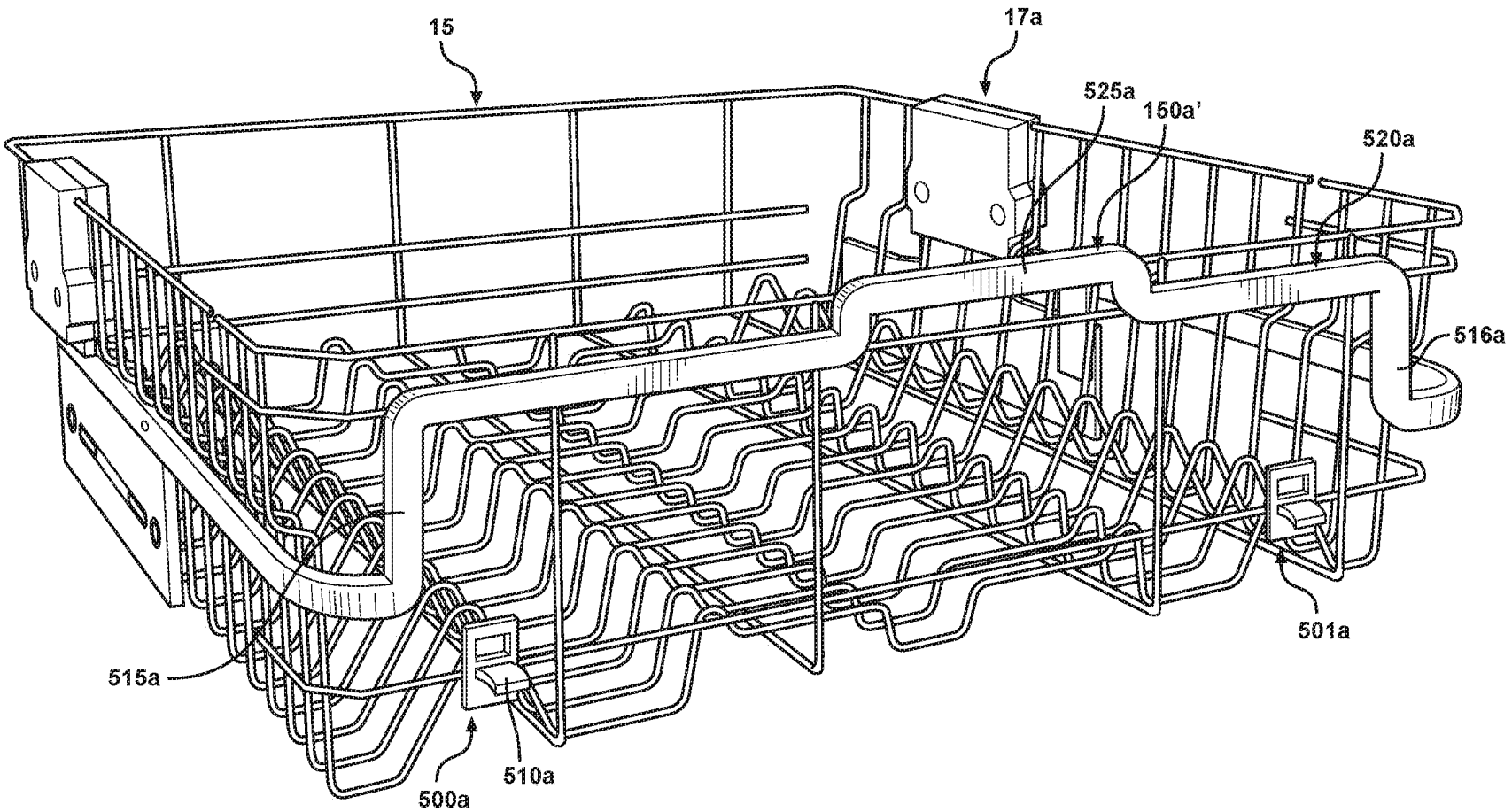

Instead of incorporating the latching mechanisms within the support bodies 133*a*, it is possible to employ latches which hold the control arm, and thereby lower dish rack 15 indirectly, in the raised position. FIGS. 33 and 34 show one potential embodiment wherein spaced latch members 500*a* and 501*a* are fixedly mounted to dish rack 15, with each latch member 500*a*, 501*a* including a retainer element 510*a* in the form of a flexible tab element. In this embodiment, the depicted control arm 150*a* is actually shown as a variant to control arm 150*a* by including elevating side legs 515*a* and 516*a* which are interconnected by a cross bar 520*a* having an offset central portion 52*a*. In any case, dish rack 15 can be raised by manually lowering cross bar 520*a* from the position shown in FIG. 33 until cross bar 520*a* is forced below the deflecting retainer elements 510*a* as shown in FIG. 34, at which point the retainer elements 510*a* will hold control arm 150*a*' in this position. When it is desired to lower dish rack 15, a user need only pull up on cross bar 520*a* to again deflect retainer elements 510*a* in order to release cross bar 520*a* and allow cross bar 520*a* to again assume the position shown in FIG. 33.

Figure 35:
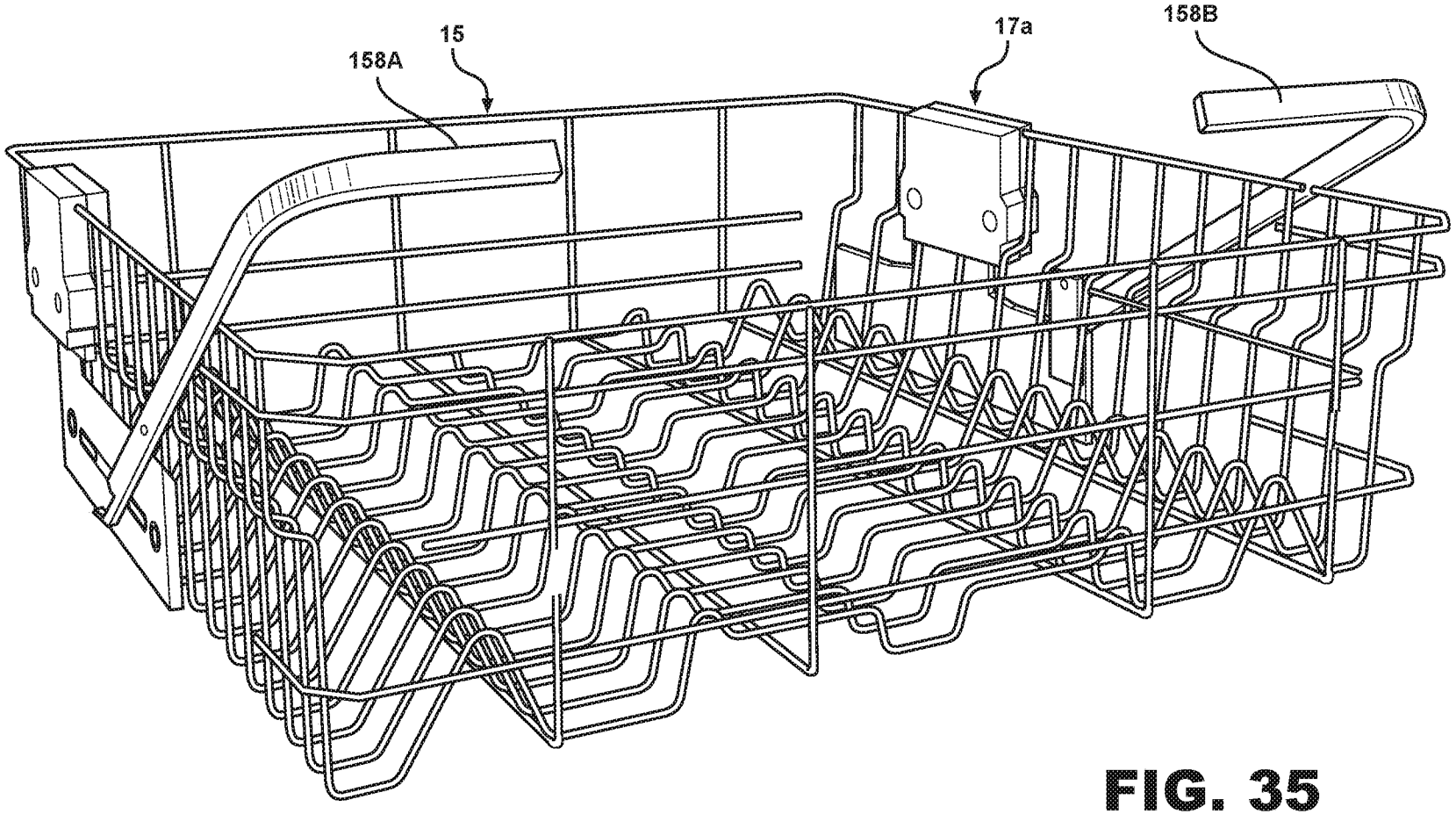
FIG. 35 is a perspective view, also similar to that of FIG. 2, illustrating an additional variation for the control arm arrangement for the height adjustment mechanism in accordance with the invention.
Figure 36:
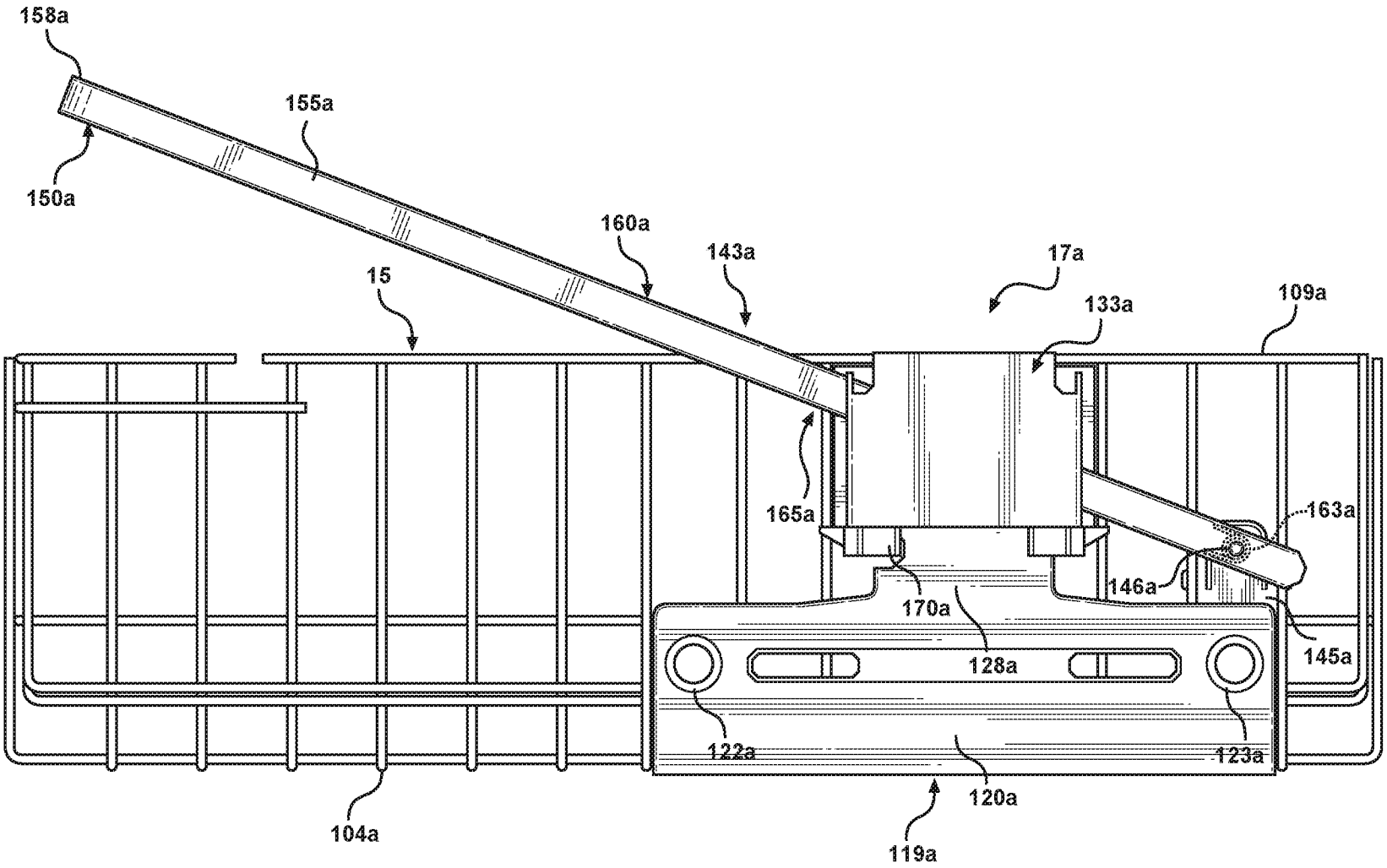
FIG. 36 is an elevational view of yet another embodiment of the rack with the height adjustment mechanism of the invention.

Based on the above, it should be readily apparent that the inclusion of a pivotal frontal cross bar in accordance with the invention provides a user easy access to the controls necessary to readily raise or lower the dish rack, regardless of the particular type of latching mechanism employed. Although described with respect to preferred embodiments of the invention, it should be readily understood that various changes and/or modifications can be made to the invention without departing from the spirit thereof. For instance, in each of the embodiments described above, the latching mechanisms were simultaneously operated by manually manipulating a unitary control arm, including side bars and a front cross bar. However, the control arm could also be formed from multiple pieces, such as side levers which are riveted or otherwise secured to a frontal cross bar, or separate cross arms could be provided for each of the side latching mechanisms, with each control arm establishing a frontal cross bar segment that only extends partially across the front of the dish rack. This alternative arrangement is represented in FIG. 35 including frontal cross bar segments 158A and 158B each extending only partially across the front wall of the dish rack, being spaced from each other, and being directly connected to only a respective one of the first and second lever members. Basically, with this arrangement, the only difference is that a user would utilize both hands to manipulate the raising or lowering of the dish rack. Regardless of whether one, two or more components are utilized to establish the control arm with the frontal portion in accordance with the invention, it is also possible to shift the pivot points for the side levers. For example, each side lever could be extended and pivoted about its terminal end, with a corresponding repositioning of its related pivot support bracket, with the intermediate portion of the side lever directly lifting the shiftable support body and rack. This alternative arrangement is represented in FIG. 36 utilizing corresponding reference numerals to that described above, particularly with reference to FIG. 32. In general, the invention is only intended to be limited by the scope of the following claims.

What is claimed is:

1. An adjustment mechanism for a dishwasher rack, comprising:

a first support body and a second support body each including an outer body and an inner body and configured to be fixed to the dishwasher rack;

a first base member including an upper body portion;

a second base member including an upper body portion, wherein the upper body portion of the first and second base members are operably coupled to the first support body and the second support body, respectively;

a plurality of support brackets operably coupled to the first and second base members; and a control arm including a frontal cross bar and a first side lever and a second side lever each coupled to the frontal cross bar, wherein the frontal cross bar is configured to raise and lower the control arm and extend along a front portion of the dishwasher rack, and wherein each of the first and second side levers includes an intermediate section and a terminal section operably coupled to each of the first and second base members, respectively.

2. The adjustment mechanism of claim 1, wherein the terminal section of each of the first and second side levers extends through a slot defined by each of the first support body and the second support body, respectively.

3. The adjustment mechanism of claim 2, wherein each of the first and second support bodies includes a locating element operably coupled to the terminal section of each of the first and second side levers, respectively.

4. The adjustment mechanism of claim 1, wherein the upper body portion of each of the first and second base members is coupled to the inner body of each of the first support body and the second support body, respectively.

5. The adjustment mechanism of claim 1, wherein the frontal cross bar includes a first cross bar and a second cross bar, wherein the first and second cross bars are operably coupled to the first and second base members, respectively.

6. A dish rack for a dishwasher, comprising:

a front wall;

first and second side walls;

a first support body and a second support body each including an outer body and an inner body and fixedly coupled to the first and second side walls, respectively;

a first base member including an upper body portion operably coupled to the first side wall and the first support body;

a second base member including an upper body portion operably coupled to the second side wall and the support body;

a control arm including a first side lever and a second side lever, wherein the control arm includes a frontal cross bar extending along the front wall and integrally formed with the first and second side levers, and wherein each of the first and second side levers and the cross bar are configured to raise and lower the dish rack via the control arm; and a plurality of support brackets pivotally coupled to the control arm.

7. The dish rack of claim 6, wherein the first and second support bodies are operably coupled to the first and second side levers, respectively.

8. The dish rack of claim 6, wherein the plurality of support brackets includes a first support bracket and a second support bracket, and further wherein the first and second support brackets include a first plate and a second plate, respectively.

9. The dish rack of claim 8 wherein the first and second side levers of the control arm are pivotally coupled to the first and second plates of the first and second support brackets, respectively.

10. The dish rack of claim 8, wherein the first and second plates each include a pin, wherein the pin of each of the first and second plates is pivotally coupled to the control arm.

11. A rack for a dishwasher, comprising:

a front wall;

a side wall;

a support body fixed to the side wall and including an outer body and an inner body;

a base member operably coupled to the side wall and the support body, wherein the base member includes an upper body portion and a lower body portion, and wherein a first latch arm and a second latch arm are operably coupled to the upper body portion;

at least one control arm that includes at least one frontal cross bar extending along the front wall, wherein a terminal section of the at least one control arm is selectively coupled to the first and second latch arms; and a support bracket pivotally coupled to the control arm.

12. The rack of claim 11, wherein the at least one frontal cross bar includes a first cross bar and a second cross bar, and further wherein the first and second cross bars define a central portion of the at least one control arm.

13. The rack of claim 11, wherein the support body includes a retainer element, and wherein the retainer element is operably coupled to the second latch arm in a raised position.

14. The rack of claim 11, wherein the at least one control arm includes a first control arm and a second control arm, and wherein the first and second control arms include a first frontal cross bar and a second frontal cross bar, respectively.

15. The rack of claim 11, wherein the support bracket includes a plate and a pin, and wherein the pin pivotally couples the at least one control arm to the support bracket via the plate.

16. The rack of claim 11, wherein the at least one control arm includes an elevating side leg coupled to the at least one frontal cross bar.

* * * * *